US011324273B2

(12) United States Patent
Weber et al.

(10) Patent No.: US 11,324,273 B2
(45) Date of Patent: May 10, 2022

(54) OMNIDIRECTIONAL ENERGY MANAGEMENT SYSTEMS AND METHODS

(71) Applicant: 6D Helmets, LLC, Brea, CA (US)

(72) Inventors: Robert Weber, Fullerton, CA (US); Robert Daniel Reisinger, Newhall, CA (US)

(73) Assignee: 6D HELMETS, LLC, Brea, CA (US)

( * ) Notice: Subject to any disclaimer, the term of this patent is extended or adjusted under 35 U.S.C. 154(b) by 326 days.

(21) Appl. No.: 16/442,384

(22) Filed: Jun. 14, 2019

(65) Prior Publication Data

US 2019/0297985 A1 Oct. 3, 2019

Related U.S. Application Data

(63) Continuation-in-part of application No. 15/186,418, filed on Jun. 17, 2016, now Pat. No. 10,561,192, which is a continuation-in-part of application No. 14/607,004, filed on Jan. 27, 2015, now Pat. No. 9,820,525, which is a continuation of application No. 13/368,866, filed on Feb. 8, 2012, now Pat. No. 8,955,169.

(60) Provisional application No. 62/861,260, filed on Jun. 13, 2019, provisional application No. 62/685,895, filed on Jun. 15, 2018, provisional application No. 62/188,598, filed on Jul. 3, 2015, provisional (Continued)

(51) Int. Cl.

| | |
|---|---|
| ***A42B 3/12*** | (2006.01) |
| ***A42B 3/06*** | (2006.01) |
| ***A42B 3/08*** | (2006.01) |
| ***A42B 3/20*** | (2006.01) |

(52) U.S. Cl.

CPC ..... *A42B 3/125* (2013.01); *A42B 3/063* (2013.01); *A42B 3/064* (2013.01); *A42B 3/08* (2013.01); *A42B 3/085* (2013.01); *A42B 3/205* (2013.01)

(58) Field of Classification Search

CPC combination set(s) only.

See application file for complete search history.

(56) References Cited

U.S. PATENT DOCUMENTS

| | | |
|---|---|---|
| 3,039,108 A | 6/1962 | Lohrenz |
| 3,413,656 A | 12/1968 | Vogliano et al. |

(Continued)

FOREIGN PATENT DOCUMENTS

| | | |
|---|---|---|
| CA | 693175 | 8/1964 |
| CN | 1316207 | 10/2001 |

(Continued)

*Primary Examiner* — Khaled Annis

(74) *Attorney, Agent, or Firm* — Haynes and Boone, LLP

(57) ABSTRACT

Systems and methods of a safety helmet for protecting the human head against repetitive impacts, moderate impacts and severe impacts so as to significantly reduce the likelihood of both translational and rotational brain injury and concussions can be provided. The helmet can include an outer shell, an omnidirectional liner disposed within and coupled to the outer shell and configured to move relative to the outer shell, and a chinstrap coupled to the omnidirectional liner. The chinstrap coupled to the omnidirectional liner can hold a wearer's head to the omnidirectional liner and prevent the chinstrap from applying forces to the wearer while omnidirectional liner moves relative to outer shell. Other embodiments may include a chinguard with a movable chincup.

19 Claims, 17 Drawing Sheets

Related U.S. Application Data application No. 62/181,121, filed on Jun. 17, 2015, provisional application No. 61/554,351, filed on Nov. 1, 2011, provisional application No. 61/462,914, filed on Feb. 9, 2011.

(56) References Cited

U.S. PATENT DOCUMENTS

| | | | | |
|---|---|---|---|---|
| 3,877,076 | A | 4/1975 | Summers et al. | |
| 4,012,794 | A | 3/1977 | Nomiyama | |
| 4,024,586 | A | 5/1977 | Lamb | |
| 4,064,565 | A | 12/1977 | Griffiths | |
| 4,213,202 | A | 7/1980 | Larry | |
| 4,290,149 | A | 9/1981 | Aileo | |
| 4,307,471 | A | 12/1981 | Lovell | |
| 4,345,338 | A | 8/1982 | Frieder, Jr. et al. | |
| 4,432,099 | A | 2/1984 | Grick et al. | |
| 4,472,472 | A | 9/1984 | Schultz | |
| 4,555,816 | A | 12/1985 | Broersma | |
| 4,586,200 | A | 5/1986 | Poon | |
| 4,627,114 | A | 12/1986 | Mitchell | |
| 4,987,609 | A | 1/1991 | Zahn | |
| 5,068,922 | A | 12/1991 | Zahn | |
| 5,086,520 | A | 2/1992 | Arai | |
| 5,204,998 | A | 4/1993 | Liu | |
| 5,309,576 | A | 5/1994 | Broersma | |
| 5,581,819 | A | 12/1996 | Garneau | |
| 5,619,756 | A | 4/1997 | Garneau | |
| 5,669,079 | A | 9/1997 | Morgan | |
| 5,815,846 | A | 10/1998 | Calonge | |
| 5,833,796 | A | 11/1998 | Matich | |
| 5,950,244 | A | 9/1999 | Fournier et al. | |
| 5,956,777 | A | 9/1999 | Popovich | |
| 5,978,972 | A | 11/1999 | Stewart et al. | |
| 6,009,566 | A | 1/2000 | Hubbard | |
| 6,052,835 | A | 4/2000 | O'Shea | |
| 6,070,271 | A | 6/2000 | Williams | |
| 6,070,905 | A | 6/2000 | Renault | |
| 6,093,468 | A | 7/2000 | Toms et al. | |
| 6,314,586 | B1 | 11/2001 | Duguid | |
| 6,378,140 | B1 | 4/2002 | Araham et al. | |
| 6,401,260 | B1 | 6/2002 | Porth | |
| 6,418,564 | B1 | 7/2002 | Sheridan | |
| 6,453,476 | B1 | 9/2002 | Moore, III | |
| 6,536,052 | B2 | 3/2003 | Tao et al. | |
| 6,560,787 | B2 | 5/2003 | Mendoza | |
| 6,658,671 | B1 | 12/2003 | Von Holst et al. | |
| 6,711,751 | B1 * | 3/2004 | Muskovitz | A42B 3/04 2/10 |
| 6,751,808 | B2 | 6/2004 | Puchalski | |
| 6,925,657 | B2 | 8/2005 | Takahashi et al. | |
| 6,931,669 | B2 | 8/2005 | Ashline | |
| 6,996,856 | B2 | 2/2006 | Puchalski | |
| D521,191 | S | 5/2006 | Berger | |
| 7,076,811 | B2 | 7/2006 | Puchalski | |
| 7,159,249 | B2 | 1/2007 | Dennis et al. | |
| 7,207,071 | B2 | 4/2007 | Pierce | |
| 7,299,505 | B2 | 11/2007 | Dennis et al. | |
| 7,328,462 | B1 | 2/2008 | Straus | |
| 7,376,981 | B2 | 5/2008 | Shida | |
| 7,574,754 | B2 | 8/2009 | Arai | |
| 7,676,854 | B2 | 3/2010 | Berger et al. | |
| 7,735,157 | B2 | 6/2010 | Ikeda | |
| 7,735,158 | B2 | 6/2010 | Tsurumi | |
| 7,748,059 | B2 | 7/2010 | Arai | |
| 7,802,320 | B2 | 9/2010 | Morgan | |
| 7,832,023 | B2 | 11/2010 | Crisco | |
| 7,895,681 | B2 | 3/2011 | Ferrara | |
| 7,930,771 | B2 | 4/2011 | Depreitere et al. | |
| 9,089,180 | B2 | 7/2015 | Phipps et al. | |
| 9,388,873 | B1 | 7/2016 | Phipps et al. | |
| 9,439,469 | B2 | 9/2016 | Phipps et al. | |
| 9,549,582 | B2 | 1/2017 | Phipps et al. | |
| 9,879,741 | B2 | 1/2018 | Phipps et al. | |
| 10,029,633 | B2 | 7/2018 | Phipps et al. | |
| 2001/0032351 | A1 | 10/2001 | Nakayama et al. | |
| 2002/0023291 | A1 | 2/2002 | Mendoza | |
| 2004/0117896 | A1 | 6/2004 | Madey et al. | |
| 2005/0246824 | A1 | 11/2005 | Berger et al. | |
| 2006/0059606 | A1 | 3/2006 | Ferrara | |
| 2007/0190292 | A1 | 8/2007 | Ferrara | |
| 2007/0190293 | A1 | 8/2007 | Ferrara | |
| 2008/0155735 | A1 | 7/2008 | Ferrara | |
| 2008/0256686 | A1 | 10/2008 | Ferrara | |
| 2009/0038055 | A1 * | 2/2009 | Ferrara | A42B 3/08 2/421 |
| 2009/0320185 | A1 | 12/2009 | Hassler | |
| 2010/0000009 | A1 | 1/2010 | Morgan | |
| 2010/0186150 | A1 | 7/2010 | Ferrara et al. | |
| 2010/0205722 | A1 | 8/2010 | Kim | |
| 2010/0258988 | A1 | 10/2010 | Darnell et al. | |
| 2010/0295221 | A1 | 11/2010 | Kligerman et al. | |
| 2011/0047685 | A1 | 3/2011 | Ferrara | |
| 2012/0060251 | A1 | 3/2012 | Schimpf | |
| 2012/0139172 | A1 | 6/2012 | Hawkins et al. | |
| 2013/0152281 | A1 * | 6/2013 | Kravitz | A42B 3/205 2/411 |
| 2013/0247284 | A1 | 9/2013 | Hoshizaki et al. | |
| 2014/0013491 | A1 | 1/2014 | Hoshizaki et al. | |
| 2014/0345036 | A1 * | 11/2014 | Sargenti | A42B 3/125 2/414 |
| 2015/0157082 | A1 | 6/2015 | Weber et al. | |
| 2015/0223547 | A1 * | 8/2015 | Wibby | A42B 3/064 2/414 |
| 2015/0250248 | A1 * | 9/2015 | Jacobsen | A42B 3/06 2/421 |
| 2017/0273389 | A1 * | 9/2017 | Muller | A42B 3/283 |
| 2018/0168268 | A1 * | 6/2018 | Grinneback | A42B 3/064 |
| 2019/0269193 | A1 * | 9/2019 | Benyola | A42B 3/044 |
| 2020/0037690 | A1 * | 2/2020 | Pomering | A42B 3/063 |

FOREIGN PATENT DOCUMENTS

| | | |
|---|---|---|
| CN | 1997506 | 7/2007 |
| CN | 101827537 | 9/2010 |
| EP | 1142495 | 10/2001 |
| EP | 2428129 | 3/2012 |
| WO | WO2011/139224 | 11/2011 |

* cited by examiner

OMNIDIRECTIONAL ENERGY MANAGEMENT SYSTEMS AND METHODS

CROSS-REFERENCE TO RELATED APPLICATIONS

This application claims the benefit of and priority to U.S. Provisional Patent Application No. 62/861,260, filed Jun. 13, 2019, entitled "OMNIDIRECTIONAL ENERGY MANAGEMENT SYSTEMS AND METHODS" and U.S. Provisional Patent Application No. 62/685,895, filed Jun. 15, 2018, entitled "OMNIDIRECTIONAL ENERGY MANAGEMENT SYSTEMS AND METHODS," the contents both of which are incorporated herein by reference in their entirety. This application is a continuation-in-part of U.S. patent application Ser. No. 15/186,418, filed Jun. 17, 2016, and entitled "OMNIDIRECTIONAL ENERGY MANAGEMENT SYSTEMS AND METHODS," which is incorporated herein by reference in its entirety. U.S. patent application Ser. No. 15/186,418 is a continuation-in-part of U.S. patent application Ser. No. 14/607,004, filed Jan. 27, 2015 (now U.S. Pat. No. 9,820,525 issued Nov. 21, 2017), entitled "HELMET OMNIDIRECTIONAL ENERGY MANAGEMENT SYSTEMS," and claims the benefit of and priority to U.S. Provisional Patent Application No. 62/181,121, filed Jun. 17, 2015, entitled "OMNIDIRECTIONAL ENERGY MANAGEMENT SYSTEMS AND METHODS," and U.S. Provisional Patent Application No. 62/188,598, filed Jul. 3, 2015, entitled "OMNIDIRECTIONAL ENERGY MANAGEMENT SYSTEMS AND METHODS," all of which are incorporated herein by reference in their entirety. U.S. patent application Ser. No. 14/607,004 is a continuation of U.S. patent application Ser. No. 13/368,866, filed Feb. 8, 2012 (now U.S. Pat. No. 8,955,169 issued Feb. 17, 2015), entitled "HELMET OMNIDIRECTIONAL ENERGY MANAGEMENT SYSTEMS," which is incorporated herein by reference in its entirety. U.S. patent application Ser. No. 13/368,866 claims the benefit of and priority to U.S. Provisional Patent Application No. 61/462,914, filed Feb. 9, 2011, entitled "HELMET OMNI-DIRECTIONAL ENERGY MANAGEMENT SYSTEM," and U.S. Provisional Patent Application No. 61/554,351, filed Nov. 1, 2011, entitled "HELMET OMNI-DIRECTIONAL ENERGY MANAGEMENT SYSTEM," all of which are incorporated herein by reference in their entirety.

TECHNICAL FIELD

One or more embodiments of the present invention generally relate to safety equipment, and more particularly for example, to protective helmets that protect the human head against repetitive impacts, moderate impacts and severe impacts so as to significantly reduce the likelihood of both translational and rotational brain injury and concussions.

BACKGROUND

Action sports (e.g., skateboarding, snowboarding, bicycle motocross (BMX), downhill mountain biking, and the like), motorsports (e.g., off-road and on-road car and motorcycle riding and racing) and traditional contact sports (e.g., football and hockey) continue to grow at a significant pace throughout the world as each of these sports expands into wider participant demographics. While technology and sophisticated training regimes continue to improve the performance capabilities for such athletes/participants, the risk of injury attendant to these activities also increases. Current "state of the art" helmets are not keeping pace with the evolution of sports and the capabilities of athletes. At the same time, science is providing alarming data related to the traumatic effects of both repetitive but moderate, and severe impacts to the head. While concussions are at the forefront of current concerns, rotational brain injuries from the same concussive impacts are no less of a concern, and in fact, are potentially more troublesome.

SUMMARY

In accordance with one or more embodiments of the present disclosure, omnidirectional impact energy management systems are provided for protective helmets that can significantly reduce both rotational and linear forces generated from impacts to the helmets over a broad spectrum of energy levels.

The novel techniques, for one or more embodiments, enable the production of safety helmets that can provide a controlled internal omnidirectional relative displacement capability, including relative rotation and translation, between the internal components thereof. The systems enhance modern helmet designs for the improved safety and well-being of athletes and recreational participants in sporting activities in the event of any type of impact to the wearer's head. These designs specifically address, among other things, the management, control, and reduction of angular acceleration forces, while simultaneously reducing linear impact forces acting on the wearer's head during such impacts.

In accordance with an embodiment, a helmet can be disclosed. The helmet can include an outer shell, an outer liner disposed within the outer shell and coupled to the outer shell, an omnidirectional liner disposed within the outer liner, coupled to the outer liner, and configured to move omnidirectionally relative to the outer liner, and a chinstrap coupled to the omnidirectional liner.

In accordance with another embodiment, a helmet chinguard can be disclosed. The helmet chinguard can include a chincup that includes a strap guide and a strap configured to be coupled to a portion of a helmet. A portion of the strap may be disposed within the strap guide, and the chincup may be configured to move along a portion of the strap to move relative to the helmet.

The scope of this invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly, and within which like reference numerals are used to identify like elements illustrated in one or more of the figures thereof.

DETAILED DESCRIPTION

In accordance with one or more embodiments of this disclosure, omnidirectional impact energy management systems for helmets and/or chinguards are provided that can significantly reduce both rotational and linear forces generated from impacts imparted to the helmets. The systems enable a controlled internal omnidirectional relative displacement capability, including relative rotational and translational movement, between the internal components of a hard shelled safety helmet.

One or more embodiments disclosed herein are particularly well suited to helmets that can provide improved protection from both potentially catastrophic impacts and repetitive impacts of varying force that, while not causing acute brain injury, can cause cumulative harm. The problem of cumulative brain injury, i.e., Second Impact Syndrome (SIS), is increasingly recognized as a serious problem in certain sports, such as American football, where much of the force of non-catastrophic contact is transferred to the head of the wearer. In various example embodiments, helmets are configured with dampers of specific flex and compression characteristics to manage a wide range of repetitive and severe impacts from all directions, thus addressing the multitude of different risks associated with diverse sports, such as football, baseball, bicycle riding, motorcycle riding, skateboarding, rock climbing, hockey, snowboarding, snow skiing, auto racing, and the like.

Head injuries result from two types of mechanical forces—contact and non-contact. Contact injuries arise when the head strikes or is struck by another object. Non-contact injuries are occasioned by cranial accelerations or decelerations caused by forces acting on the head other than through contact with another object, such as whiplash-induced forces. Two types of cranial acceleration are recognized, which can act separately or in combination with each other. "Translational" acceleration occurs when the brain's center of gravity (CG), located approximately at the pineal gland, moves in a generally straight line. "Rotational" or angular acceleration occurs when the head turns about its CG with or without linear movement of the CG.

Translational accelerations/decelerations can result in so-called "coup" and "contrecoup'" head injuries that respectively occur directly under the site of impact with an object and on the side of the head opposite the area that was impacted. By contrast, studies of the biomechanics of brain injury have established that forces applied to the head which result in a rotation of the brain about its CG cause diffuse brain injuries. It is this type of movement that is responsible for subdural hematomas and diffuse axonal injury (DAI), one of the most devastating types of traumatic brain injury.

Figure 1:
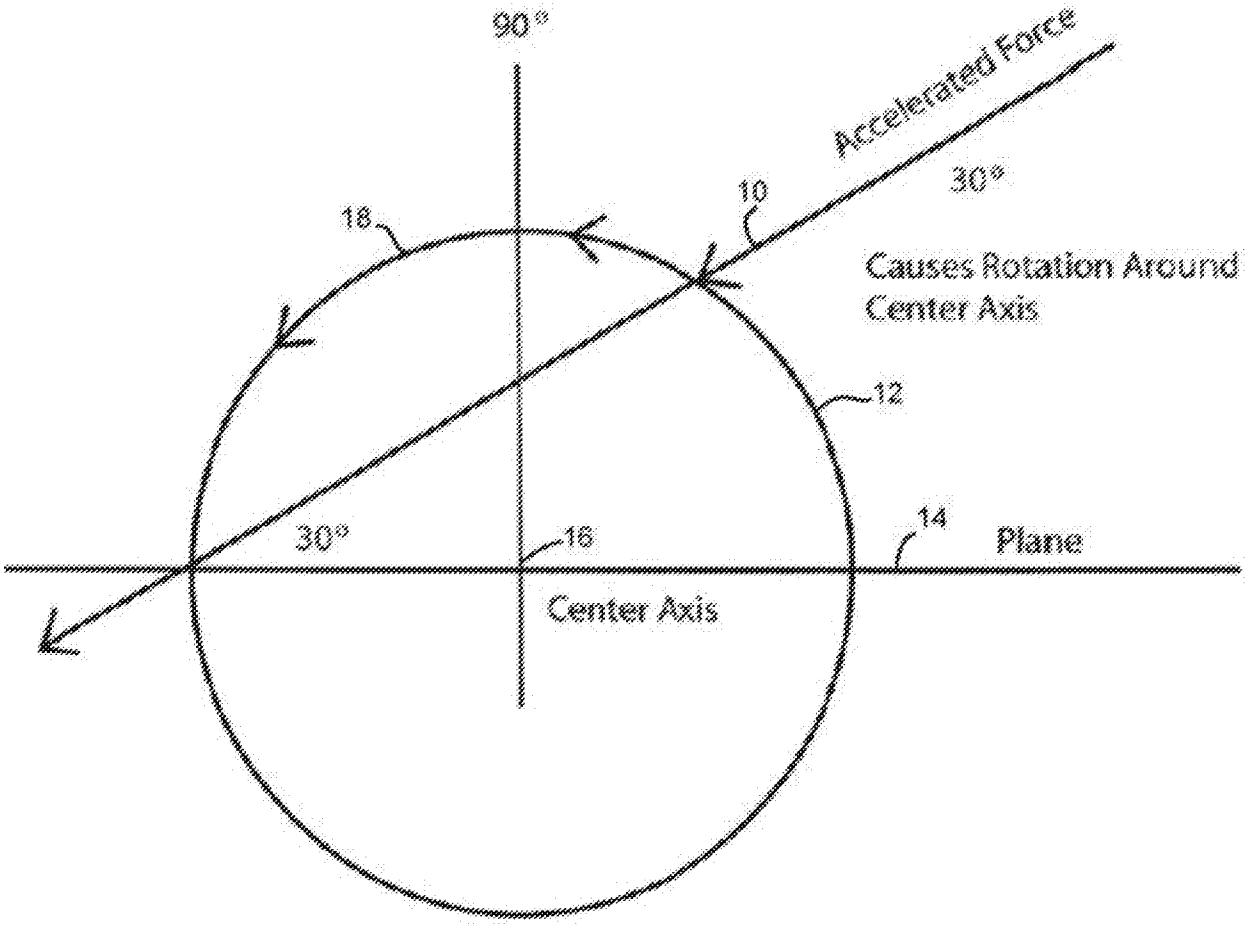
FIG. 1 is a diagram of an impact force acting on the head or helmet of a wearer so as to cause rotational acceleration of the wearer's brain around the brain's center of gravity.

Referring to FIG. 1, the risk of rotational brain injury is greatest when an impact force 10 is applied to the head or helmet 12 of a wearer from at an oblique angle, i.e., greater or less than 90 degrees to a perpendicular plane 14 drawn through the CG 16 of the brain. Such impacts cause rotational acceleration 18 of the brain around CG, potentially shearing brain tissue and causing DAI. However, given the distribution of brain matter, even direct linear or translational impacts can generate shear forces within the brain sufficient to cause rotational brain injuries. Angular acceleration forces can become greater, depending on the severity (i.e., force) of the impact, the degree of separation of the impact force 10 from 90 degrees to the perpendicular plane 14, and the type of protective device, if any, that the affected individual is wearing. Rotational brain injuries can be serious, long lasting, and potentially life threatening.

Safety helmets generally use relatively hard exterior shells and relatively soft, flexible, compressible interior padding, e.g., fit padding, foam padding, air filled bladders, or other structures, to manage impact forces. When the force applied to the helmet exceeds the capability of the combined resources of the helmet to reduce impacts, energy is transferred to the head and brain of the wearer at an accelerated rate. This can result in moderate concussion or severe brain injury, including a rotational brain injury, depending on the magnitude of the impact energy.

Safety helmets are designed to absorb and dissipate as much energy as possible over the greatest amount of time possible. Whether the impact causes direct linear or translational acceleration/deceleration forces or angular acceleration/deceleration forces, the helmet should eliminate or substantially reduce the amount of energy transmitted to the wearer's head and brain.

Figure 2:
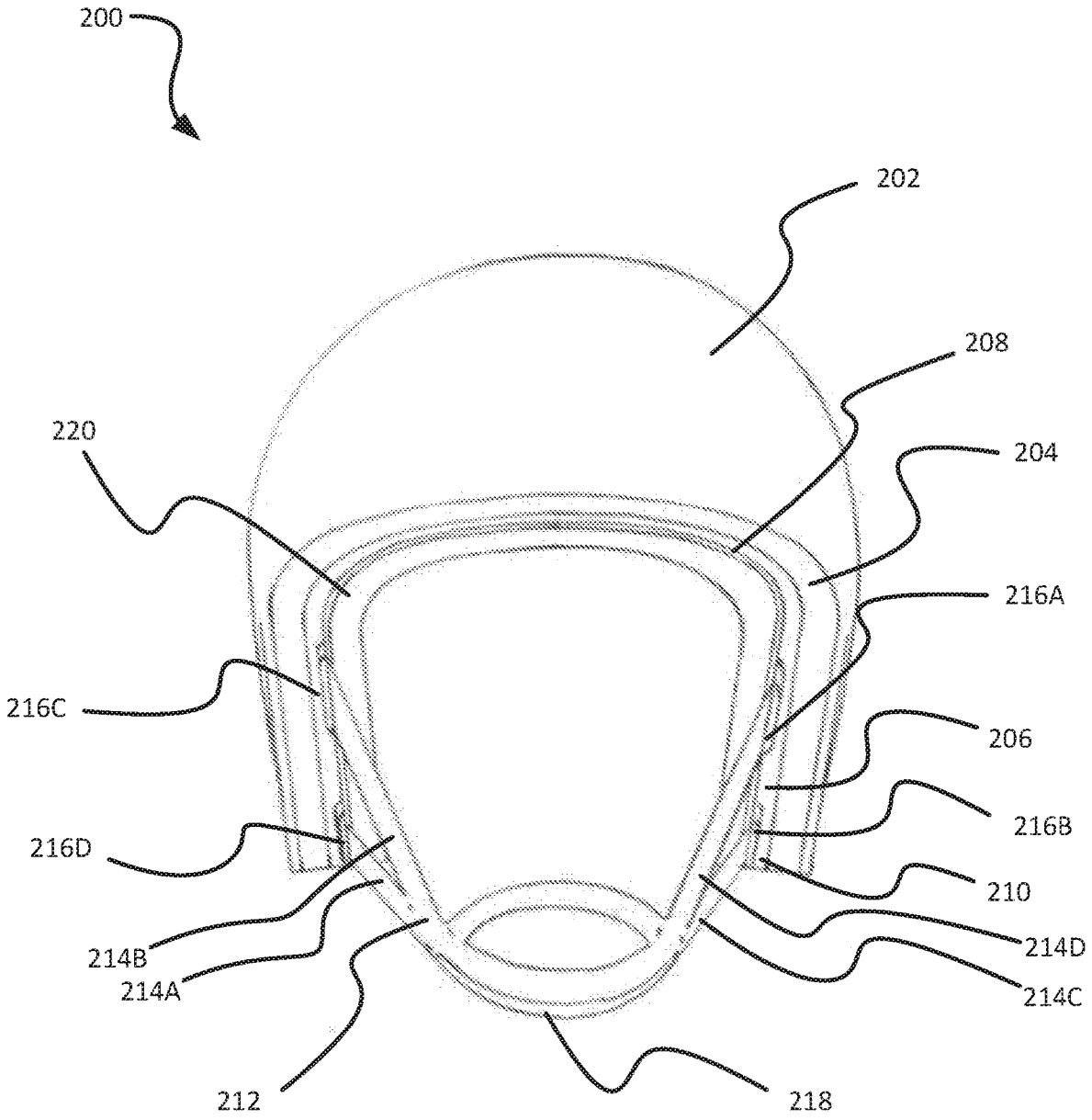
FIG. 2 is a front view of an example helmet with an internal liner coupled chinstrap, in accordance with an embodiment.
Figure 3:
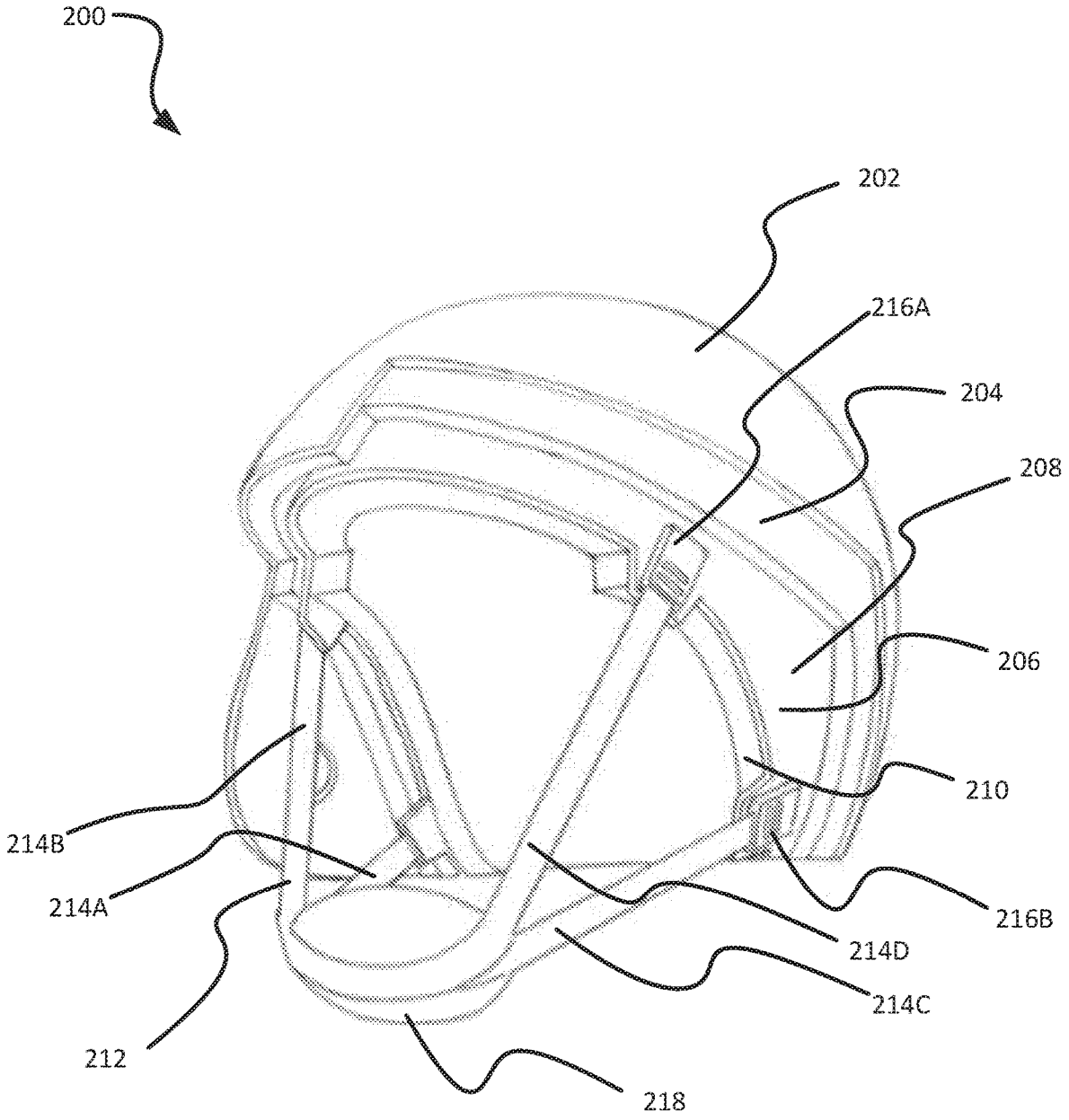
FIG. 3 is a partial cutaway prospective view of an example helmet with an internal liner coupled chinstrap, in accordance with an embodiment.

FIG. 2 is a front view of an example helmet with an internal liner coupled chinstrap, in accordance with an embodiment. FIG. 3 is a partial cutaway prospective view of an example helmet with an internal liner coupled chinstrap, in accordance with an embodiment. FIGS. 2 and 3 illustrate helmet 200 that includes outer shell 202, outer liner 204, omnidirectional liner 206, chinstrap 212, and comfort liner 220.

Outer shell 202 can be a relatively soft or hard shell that forms an outer structure that contains other components of helmet 200. In embodiments with a relatively hard outer shell 202, the relatively hard outer shell 202 can be manufactured from conventional materials, such as fiber-resin lay-up type materials, polycarbonate plastics, polyurethane, or any other appropriate materials, in various thicknesses of material, depending on the specific application intended for the helmet 200.

Outer liner 204 can be coupled or connected (e.g., coupled via fasteners and/or adhesives or directly connected through in-molding or co-molding) to outer shell 202. Outer shell 202 can be disposed at least partially circumferentially around outer liner 204. Thus, an outer side of outer liner 204 can be configured to be disposed within an inner side of outer shell 202. A shape of the outer side of outer liner 204 can substantially match a shape of an inner side of outer shell 202. In certain embodiments, the inner side of outer shell 202 and/or the outer side of outer liner 204 can include one or more features to prevent outer liner 204 from moving excessively relative to outer shell 202. As described herein, the "inner side" can be the side of the component closer to the head of the wearer when helmet 200 is worn. By contrast, the "outer side" is the side of the component farther away from the head of the wearer (relative to the inner side) when helmet 200 is worn.

Omnidirectional liner 206 can be configured to move omnidirectionally relative to outer liner 204. Thus, omnidirectional liner 206 can translate and/or rotate in a plurality of different directions relative to outer liner 204 in certain situations (e.g., when helmet 200 receives an impact or a force). The omnidirectional liner 206 can therefore substantially move (e.g., translate or rotate) in a plurality of different directions relative to outer liner 204. For example, omnidirectional liner 206 may rotate relative to outer liner 204 when helmet 200 is subject to an oblique force. One or dampers and/or other features of outer liner 204 and/or omnidirectional liner 206 may allow for such omnidirectional movement of omnidirectional liner 206 relative to outer liner 204.

Omnidirectional liner 206 can be configured to be disposed circumferentially within outer liner 204. In such configurations, an outer side of omnidirectional liner 206 can be configured to be disposed within an inner side of outer liner 204. A shape of the outer side of omnidirectional liner 206 can substantially match a shape of an inner side of outer liner 204. In certain other embodiments, omnidirectional liner 206 can be disposed directly within an inner side of outer shell 202. Thus, in such configurations, helmet 200 may not include outer liner 204 and a shape of the outer side of omnidirectional liner 206 can substantially match a shape of an inner side of outer shell 202. In certain embodiments, outer shell 202 may include two or more materials (e.g., polycarbonate and EPS). The two or more materials can be in-molded together to create a monolithic structure. In certain such embodiments, the structure of the two or more materials molded together can be relatively thin (e.g., similar to the thickness of just an outer shell of a configuration with both an outer shell and an outer liner).

In other embodiments, omnidirectional liner 206 can be coupled to outer shell 202 via, for example, one or more omnidirectional dampers or other components as described herein. Other embodiments may include outer liner 204, but omnidirectional liner 206 can be connected or coupled to outer shell 202 (e.g., coupled through outer liner 204) or coupled to outer shell 202 via outer liner 204.

Omnidirectional liner 206 can be configured to be disposed in contact with a wearer's head, either directly or via a fitment of a so-called "comfort liner" (e.g., comfort liner 220). Outer liner 204, omnidirectional liner 206, and/or comfort liner 220 can be a semispheroidal hollow liner. Outer liner 204, omnidirectional liner 206, and/or other liners can be formed of any suitable material, including energy absorbing materials such as expanded polystyrene (EPS) or expanded polypropylene (EPP). Such material can be configured to deform when subjected to a force (e.g., from an external impact). The deformation can absorb the force and protect a wearer's head. In certain embodiments, the force can be absorbed through a combination of one or more liners and/or other features additional to outer liner 204 and omnidirectional liner 206.

In certain embodiments, the inner side of outer liner 204 and/or the outer side of omnidirectional liner 206 can include one or more features to prevent omnidirectional liner 206 from moving excessively relative to outer liner 204. However, certain embodiments can allow for omnidirectional liner 206 to move relative to outer liner 204 (e.g., can allow for rotation of omnidirectional liner 206 relative to outer liner 204) up to a threshold amount and can be configured to be constrained such that relative movement is prevented if the relative movement is greater than the threshold amount.

Omnidirectional liner 206 can include one or more component liners. For example, omnidirectional liner 206 can include polymer liner 208 and compressible liner 210. Helmet 200 illustrates an embodiment where compressible liner 210 is disposed between polymer liner 208 and outer liner 204. Other embodiments may dispose polymer liner 208 between compressible liner 210 and outer liner 204.

Polymer liner 208 can be a relatively rigid liner (e.g., constructed from plastic, composite, metal, and/or other suitable material) and, in certain embodiments, can be constructed from a material with a modulus of elasticity higher than that of compressible liner 210. In certain embodiments, polymer liner 208 can be configured to tune the allowable movement of omnidirectional liner 206 relative to outer liner 204 (e.g., by allowing for a surface for outer liner 204 to slide upon) and be configured to couple to chinstrap 212. In certain other embodiments, chinstrap 212 can be coupled to compressible liner 210 and/or another portion of omnidirectional liner 206.

Typically, a helmet's chinstrap is attached to the rigid outer shell of the helmet. Coupling chinstrap 212 to omnidirectional liner 206, as described herein, can allow for the wearer's head, when wearing chinstrap 212, to be securely held within omnidirectional liner 206 and allow for outer liner 204 and/or outer shell 202 to move omnidirectionally relative to the wearer's head. Thus, when helmet 200 receives an impact, omnidirectional liner 206 can move omnidirectionally relative to outer shell 202 and/or outer liner 204 without imparting unnecessary stresses, via chinstrap 212, on the wearer's jaw or another portion of the wearer and, thus, reduce the potential of injury to the wearer.

Referring back to polymer liner 208 can be coupled to compressible liner 210, outer liner 204, and/or other such liner and/or another portion of helmet 200 via, for example, mechanical fasteners such as bolts, nuts, standoffs, pins, snaps, rivets, or other such fasteners, adhesives, friction fits, and/or another such technique. In certain other embodiments, polymer liner 208 can be co-molded onto compressible liner 210 and/or another portion of helmet 200.

Compressible liner 210 can be coupled to polymer liner 208 and be configured to deform when helmet 200 receives an impact. In certain embodiments, compressible liner 210 can be much more compressible than polymer liner 208. Thus, compressible liner 210 can be configured to absorb impact force. In such embodiments, compressible liner 210 can be configured to absorb a majority of axial force imparted onto omnidirectional liner 206. Accordingly, in certain embodiments, compressible liner 210 can be a first thickness and polymer liner 208 can be a second thickness. The first thickness may be thicker than the second thickness.

Chinstrap 212 can, as described herein, be coupled to omnidirectional liner 206 and be configured to securely hold a wearer's head to omnidirectional liner 206. In certain embodiments, at least a portion of chinstrap 212 can be configured to be located below the wearer's chin when worn. Chinstrap 212 can include chinstrap portions 214A-D and chincup 218. Chinstrap portions 214A-D can be separate portions of chinstrap 212. Chinstrap portions 214A and 214B may be right portions of the chinstrap 212 and chinstrap portions 214C and 214D may be left portions of the chinstrap 212. Chincup 218 may be disposed on a central portion of chinstrap 212.

As shown, the four portions 214A-D of chinstrap 212 can allow for chinstrap 212 to more securely hold a wearer's head within omnidirectional liner 206. One or more of the various chinstrap portions 214A-D can be configured to be disposed adjacent to a wearer's ears. Chincup 218 can be configured to receive and hold a wearer's chin and, thus, allow for chinstrap 212 to more securely hold the wearer's head.

Chinstrap 212 can be coupled to omnidirectional liner 206 (e.g., polymer liner 208) via attachments 216A-D. As illustrated in FIGS. 2 and 3, each of an end of chinstrap portions 214A-D may be coupled to polymer liner 208 via a respective attachment 216A-D. Certain embodiments may couple chinstrap portions 214A-D to a peripheral (e.g., proximate an edge) portion of the polymer liner 208 and/or along another portion of another liner. Attachment 216A-D can be one or more of magnetic couplings, snaps, stitching, rivets, buckles, threaded fasteners, or cables. Certain embodiments can include one or more ports or windows within the outer shell and/or the liners to allow access to attachments 216A-D. Attachments 216A-D may be manipulated to attach or release chinstrap portions 214A-D (e.g., via a release button or lever). Certain embodiments of attachments 216A-D may allow for rotation and/or limited movement of the end of the chinstrap portions 214A-D relative to the polymer liner 208. Allowing such movement may, for example, improve user comfort and helmet impact absorption properties by allowing for a more secure fit.

Figure 4:
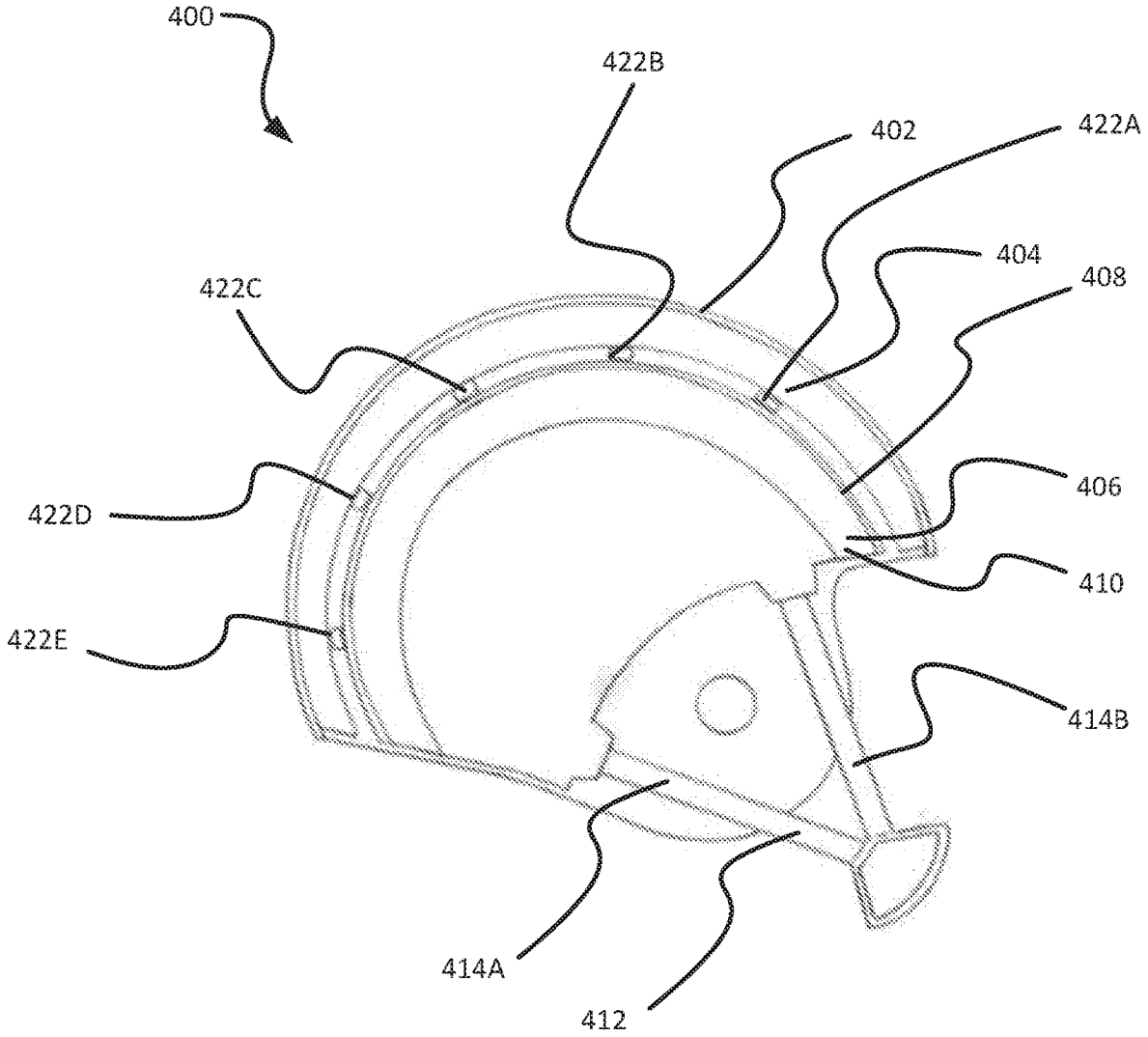
FIG. 4 is a side cross-sectional view of the example helmet with an internal liner coupled chinstrap, in accordance with an embodiment.

FIG. 4 is a side cross-sectional view of the example helmet with an internal liner coupled chinstrap, in accordance with an embodiment. FIG. 4 illustrates helmet 400 that includes outer shell 402, outer liner 404, omnidirectional liner 406, chinstrap 412, and dampers 422A-E. The embodiment of helmet 400 illustrates an omnidirectional liner 406 that includes polymer liner 408 and compressible liner 410 with polymer liner 408 disposed between compressible liner 410 and outer liner 404. Other embodiments may include outer liners and/or omnidirectional liners of other configurations, including liners of any number of compressible liners and polymer liners disposed in various configurations.

Outer liner 404 is coupled to omnidirectional liner 406 via dampers 422A-E. Embodiments of dampers 422A-E may be coupled to various components of helmet 400 including portions of outer liner 404 and/or omnidirectional liner 406. Dampers 422A-E can include a first end, a second end, and a damper body and can, for example, can be coupled to outer liner 404 at the first end and coupled to polymer liner 408 at the second end. The damper body can allow relative movement between the first end and the second end. For example, damper body can be flexible and allow the first end to translate and/or rotate relative to the second end. In certain embodiments, dampers 422A-E or a portion thereof can be elastomeric.

The first end and/or the second end of dampers 422A-E can include concave and/or convex features to couple to and/or be disposed within portion of the respective liner. Such features can be complementary in shape to features of the respective liner. For example, dampers 422A-E can include elongated cylindrical members having opposite ends respectively retained within inserts attached to the respective liner. Such inserts can include a variety of different materials and configurations and can be attached to the corresponding liner and/or carrier via a variety of attachment techniques.

Dampers 422A-E can be provided at selected points around the circumfery of helmet 100. Dampers 422A-E of different designs can be provided for specific applications and effectively "tuned" to manage the anticipated rotational and translational forces applied thereto. Dampers 422A-E can be configured in a wide range of configurations and materials varying from those shown and described in the example embodiments, and the general principles described herein can be applied without departing from the spirit and scope of the invention. In certain embodiments, dampers 422A-E can hold outer liner 404 relative to omnidirectional liner 406 in such a manner so that an air gap is disposed between outer liner 404 and omnidirectional liner 406. In certain such embodiments, the air gap may be partially or fully filled with one or more impact absorbing materials.

Figure 5A:
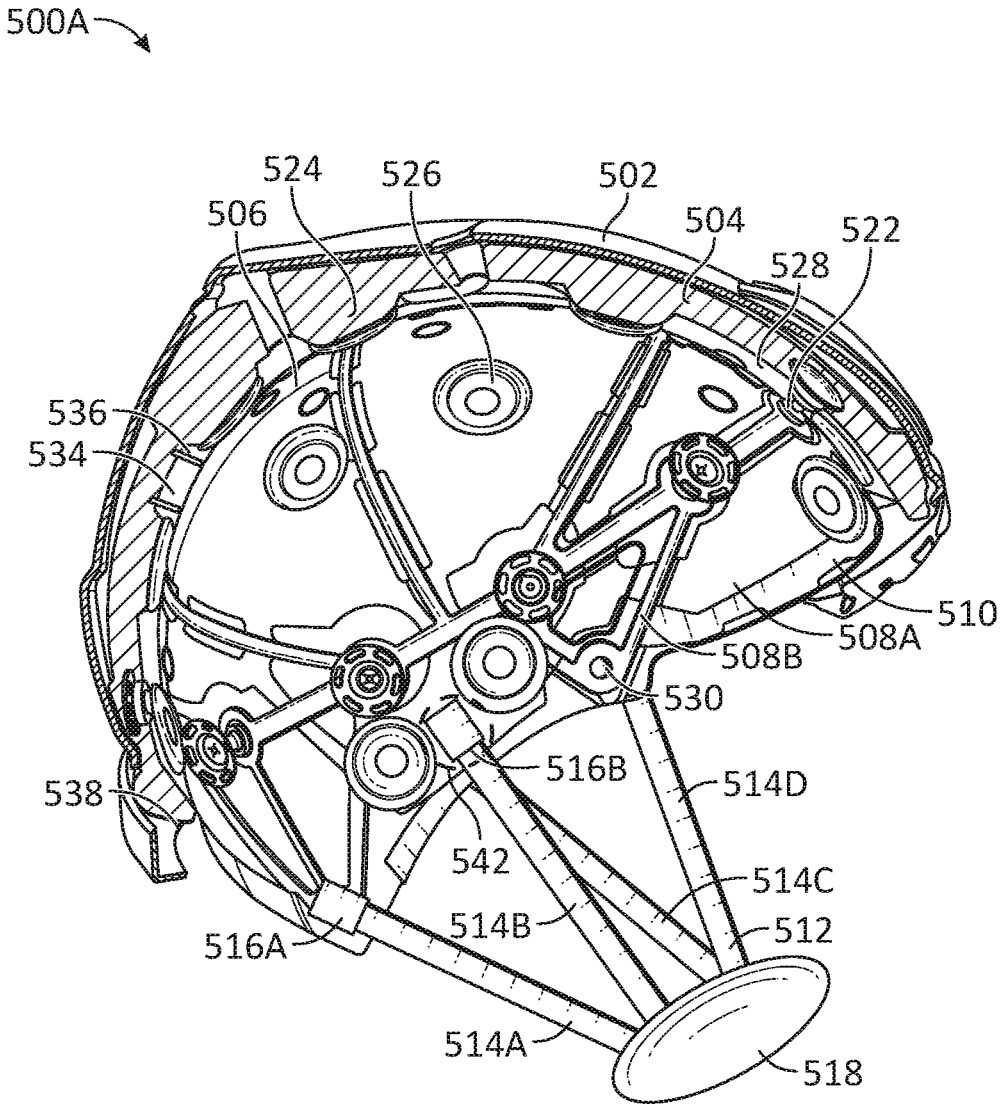
FIG. 5A is a partial side cross-sectional view of the example helmet, in accordance with an embodiment.

FIG. 5A is a partial side cross-sectional view of the example helmet, in accordance with an embodiment. FIG. 5A illustrates helmet 500A that includes outer shell 502, outer liner 504, omnidirectional liner 506, dampers 522, and chinstrap 512. Omnidirectional liner 506 can include polymer liner 508A, carrier 508B, and compressible liner 510.

Polymer liner 508A can be coupled to carrier 508B, compressible liner 510, outer liner 504, and/or another portion of helmet 500A. Polymer liner 508A can create a low friction interface between mating part surfaces (e.g., between outer liner 504 and omnidirectional liner 506 or between other components such as between outer liner 504 or omnidirectional liner 516 and an intermediate liner). The low friction interface can allow and/or enhance rotational shearing movement between the components and allow for the components to slide, rotate, and/or move relative to one another on.

Furthermore, polymer liner 508A can be coupled to or co-molded onto a surface of omnidirectional liner 506 (e.g., an outer surface of omnidirectional liner 506), and/or another component to create a structural member to enhance the structural strength. Thus, polymer liner 508A can enhance the strength of the component in compression loading, hoop tensile strength, and/or another structural aspect. Accordingly, polymer liner 508A can be constructed from a material with a higher modulus of elasticity than, for example, compressible liner 510. Polymer liner 508A (as well as, alternatively or additionally, carrier 508B and/or compressible liner 510) can form a surface or base for other components to couple to (e.g., dampers, liners, rivets, and/or other such components).

Certain embodiments of outer liner 504 and/or omnidirectional liner 506 can include protrusions 524. Protrusions 524 can be raised features such as towers, cylinders, cones, domes, ribs, standoffs, and/or other features. Protrusions 524 can be configured to create separation between two or more liners. Such separation can create a gap that allows for linear and/or rotational displacement between the two liners. Certain embodiments can include a plurality of protrusions 524. The plurality of protrusions 524 can include protrusions of varying heights. The differences in height allows for different amounts of protrusions 524 to engage and, thus, prevent deformation at different compression levels of the liners. Thus, protrusions 524 can be tuned so that only some of protrusions 524 (and/or pads 526) contact outer liner 504, omnidirectional liner 506, and/or other liners of helmet 500A when unloaded (e.g., when helmet 500A is not experiencing an impact). The position of components of helmet 500A when not experiencing an impact can be called the unloaded position or the resting spatial position. When impact forces are experienced by helmet 500A, larger forces result in progressively larger amounts of protrusions coming into contact with a corresponding liner. Having a larger amount of protrusions 524 increases resistance to deflection and, thus, prevents the liners from "bottoming out" and increases protection to the wearer. Thus, the geometry of protrusions 524 can be used to tune the impact absorption properties of helmet 500A.

While helmet 500A illustrates protrusions 524 disposed on outer liner 504, other embodiments can dispose protrusions on other liners. Protrusions can be disposed on sides of one or both adjacent liners to separate the two liners and allow for creation of a gap for omnidirectional movement.

In certain embodiments, outer liner 504 and/or omnidirectional liner 506 can include pads, such as pads 526. Pads 526 can be tuned to control relative movement between various liners of helmet 500A. For example, pads 526 can be disposed on one or more of protrusions 524 and can contact a portion of omnidirectional liner 506 (e.g., polymer liner 508A, carrier 508B, and/or compressible liner 510). Pads 526 can be configured to slide on the portion of omnidirectional liner 506. Pads 526 can be configured with a certain coefficient of friction to control relative movement of, for example, omnidirectional liner 506 relative to outer liner 504 when helmet 500A is subjected to a force (e.g., when sustaining an oblique impact). Other aspects to tune such relative movement include the area of pads 526 that contact the corresponding liner and/or the amount of pads 526 and/or protrusions 524.

While pads 526 in certain embodiments can be a separate part from the liner, in other embodiments, pads 526 can be a portion of protrusion 524 that is the same material as protrusion 524 or a different material from protrusion 524 (e.g., a separate material that is co-molded or in-molded and/or connected via snaps, interlocking geometry features on each part, and/or bonding with adhesives). Pads 526, in certain embodiments, can be coupled to multiple liners via, for example, snaps, interlocking geometry features on each part, bonding with adhesives or in-molded or co-molded. One or more of pads 526 can be made from a low friction material and/or a rigid material. Pads 526 of low friction material can allow for more relative movement between two liners. Pads 526 made from rigid materials can aid in distribution of forces from impact and thus provide further wearer protection.

In certain embodiments, pads 526 can be different coefficients of friction when contacting different surfaces. Thus, if a pad 526 contacts polymer liner 508A, the coefficient of friction can be a first coefficient of friction. If a pad 526 contacts compressible liner 510, the coefficient of friction can be a second coefficient of friction and if a pad 526 contacts carrier 508B, the coefficient of friction can be a third coefficient of friction. In various embodiments, certain pads can be disposed on outer liner 504, omnidirectional liner 506, another such liner, or a portion thereof.

Pads 526 can be positioned so that, in certain directions of rotation, one or more of pads 526 can contact a different component when moved, changing the coefficient of friction and thus the force absorption property of helmet 500A. For example, one or more of pads 526 can, in an unloaded position, be disposed on polymer liner 508A. The interface of pad 526 to polymer liner 508A can be a first coefficient of friction. Rotation of omnidirectional liner 506 relative to outer liner 504 can then cause pad 526 to contact carrier 508B. The interface of pad 526 to carrier 508B can be a second coefficient of friction and pad 526 riding over ridges of carrier 508B can provide additional resistance to movement. Thus, pads 526 can be configured to provide different amounts of rotational resistance depending on the amount of rotation and/or positioning, of the various liners of helmet 500A. As such, positioning of pad 526 relative to one or more other components of helmet 500A can be used to tune rotational resistance of omnidirectional liner 506 with respect to outer liner 504 to be progressive, digressive, or both at various points of travel. Pad 526 can also be configured to be a connected body between two or more protrusions 524 and/or be a bridging surface supported by protrusion 524 and attached to protrusion 524 or outer liner 504 with fasteners, pins, and/or adhesives, and/or bonded or co-molded into outer liner 504 and/or omnidirectional liner 506.

Air gap 528 can be disposed between liners of helmet 500A (e.g., outer liner 504 and omnidirectional liner 506) to allow relative motion between the liners. In certain embodiments, air gap 528 can be partially or fully filled by compressible material 534. Compressible material 534 can be rubber dampers, damping towers, and/or compressible gels or foams in various geometric shapes. Such features can control displacement between the liners.

Thus, compressible material 534 can be coupled to outer liner 504, omnidirectional liner 506, and/or other liners via mechanical fasteners, adhesives, and/or elastomeric bands 536 to partially fill the gap between the liners. Elastomeric bands 536 can be attached to components (e.g., compressible material 534, outer liner 504, omnidirectional liner 506, another such liner, and/or other components of helmet 500A) to couple two or more components together, but allow each component to displace linearly and/or shear rotationally relative to each other upon an impact. Elastomeric bands 536 can then pull the components back towards each other to position the components in the original positions after the impact event is over.

Carrier 508B can form a web like structure and/or be formed in another shape. Carrier 508B can be coupled to one or more liners or other components (e.g., polymer liner 508A) and strengthen the one or more liners or other components. Thus, carrier 508B can, for example, provide additional hoop strength to one or more liners (e.g., omnidirectional liner 506 and/or compressible liner 510) or other components and/or can prevent uncontrolled deflection of the liners and thus, for example, ensure that omnidirectional liner 506 always maintains a certain general shape. The shape of carrier 508B can be similar to that of the inner and/or outer surface of outer liner 504 (e.g., that of polymer liner 508A and/or compressible liner 510), omnidirectional liner 506, and/or another such component.

Carrier 508B can be co-molded into a portion of compressible liner 510 so that one or more web like arms forming the web like structure are below the outside surface of compressible liner 510. In such a configuration, only specific areas of carrier 508B are disposed on or above an outer surface of compressible liner 510. Such specific areas can be configured to be attachment points for other components such as dampers or towers and/or to provide low friction points for contact with other components. Such a configuration allows for the carrier 508B to provide increased hoop strength to omnidirectional liner 506, in addition to being configured to provide mounting and/or interface points for other components as described herein, while not or minimally creating additional surface features on the outside surface of omnidirectional liner 506.

Carrier 508B can be disposed between a plurality of components and coupled to one or more such components to provide a support structure for the components and/or to aid in aligning and positioning such components. For example, carrier 508B can be coupled to one or more of the components through, for example, mechanical fasteners such as bolts, nuts, pins, snaps, standoffs, rivets, or other such fasteners, adhesives, friction fits, and/or another such technique.

Also, carrier 508B can align and/or position additional components such as compressible members, damping towers, elastomeric dampers, compressible foams, compressible gels or any component that controls displacement between two or more components (e.g., liners) in compression and/or shear. Such additional components can be coupled and/or attached to carrier 508B via techniques described herein (e.g., via the mechanical, adhesive, and/or friction fit techniques and/or co-molded into carrier 508B) and can allow for omnidirectional displacement of components relative to one another.

In various embodiments, chinstrap 512 may be coupled to various different portions of omnidirectional liner 506. For example, chinstrap portions 514A and 514C can be coupled to carrier 508B via attachments 516A and 516C (not shown), respectively, while chinstrap portions 514B and 514D can be coupled to polymer liner 508A via attachments 516B and 516D (not shown), respectively. Attachments 516A-D can be access through ports or windows 542. Other embodiments can couple various portions of chinstrap 512 to other portions of omnidirectional liner 506.

In certain embodiments, rearward portions of helmet 500A may include a rear cutout 538. Rear cutout 538 can be in alignment with the cervical area of the spine of the wearer. Rear cutout 538 can be a central cutout configured to allow for more clearance vertically from the bottom of helmet 500A in relation to the adjacent helmet material to the left and right of rear cutout 538. Rear cutout 538 allows for deflection of the liners of helmet 500A in an outward direction. Such deflection can be caused by, for example, rotational slip of helmet 500A in the aft direction (e.g., slip towards the rear of helmet 500A). Rear cutout 538 allowing for deflection of the liners can better protect the cervical spine area of the wearer by relieving pressure from the area by allowing for displacement of the liners away from the area and, thus, preventing such displacement from exerting force on the cervical spine area.

Figure 5B:
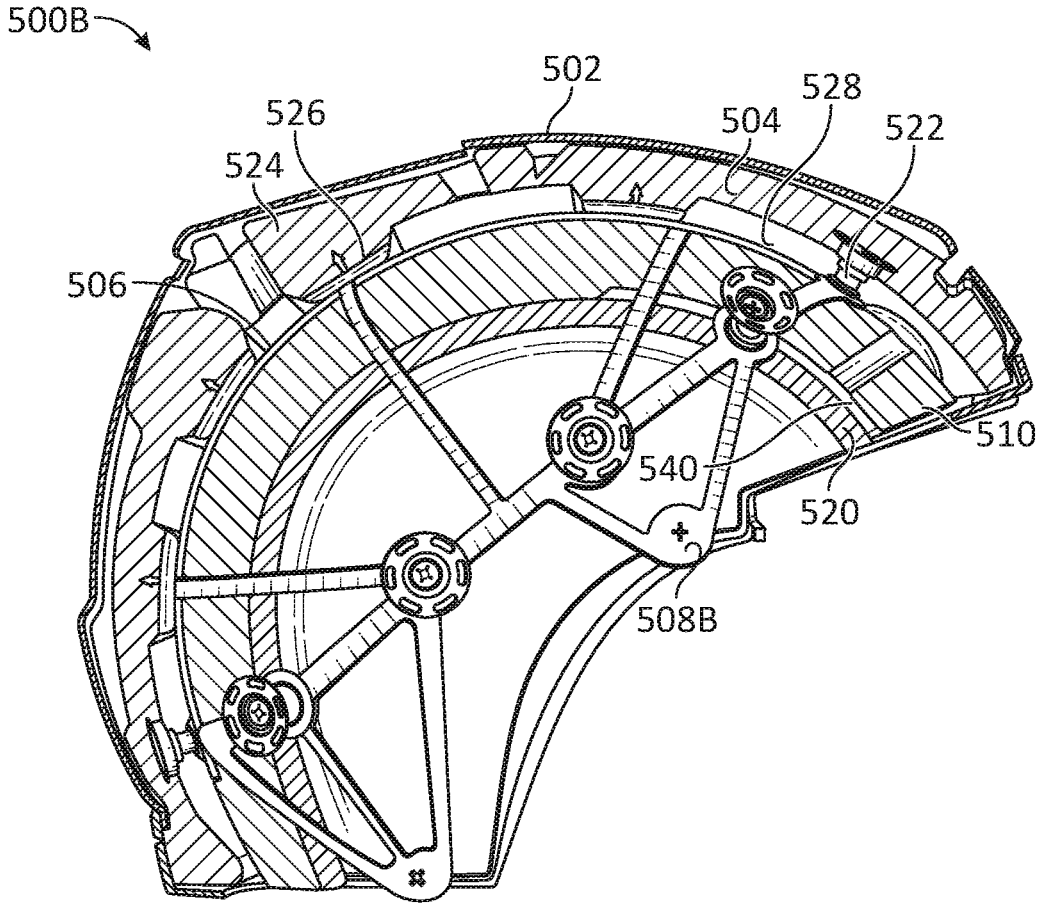
FIG. 5B is a partial side cross-sectional view of certain components of the example helmet, in accordance with an embodiment.

FIG. 5B is a partial side cross-sectional view of certain components of the example helmet, in accordance with an embodiment. Helmet 500B shown in FIG. 5B illustrates a comfort liner 520. Comfort liner 520 can be configured to be disposed between a wearer's head and omnidirectional liner 506 and be disposed in contact with the wearer's head. In certain embodiments, comfort liner 520 can be configured to be disposed circumferentially within omnidirectional liner 506. In such configurations, an outer side of comfort liner 520 can be configured to be disposed within an inner side of omnidirectional liner 506. A shape of the outer side of comfort liner 520 can substantially match a shape of an inner side of omnidirectional liner 506.

Comfort liner 520 can be a hollow, semispheroidal liner formed from any suitable material, including energy absorbing materials such as expanded polystyrene (EPS) or expanded polypropylene (EPP) to deform when subjected to a force (e.g., from an external impact). In various embodiments, the ratio of thickness between omnidirectional liner 506 or portions thereof and comfort liner 520 may vary significantly. In certain embodiments, outer liner 504, compressible liner 510 of omnidirectional liner 506, and/or comfort liner 520 can be formed from the same or different materials with different stiffness.

Comfort liner 520 can be disposed within omnidirectional liner 506 and can be configured to move omnidirectionally relative to outer liner 504 and/or outer shell 502. In certain embodiments, omnidirectional movement of comfort liner 520 relative to outer liner 504 and/or outer shell 502 can be substantially controlled by omnidirectional liner 506. Thus, comfort liner 520 may move (e.g., rotate) along with omnidirectional liner 506, relative to outer liner 504 and/or outer shell 502, when helmet 500B experiences an impact.

Air gap 540 can be disposed between comfort liner 520 and omnidirectional liner 506 to allow for certain displacement of omnidirectional liner 506 relative to comfort liner 520 and/or vice versa. Air gap 540, similar to air gap 528, is a space for omnidirectional liner 506 or portions thereof and/or comfort liner 520 to compress and/or displace into and, thus, allows for linear and/or shear displacement of omnidirectional liner 506 relative to comfort liner 520 or vice versa.

Figure 5C:
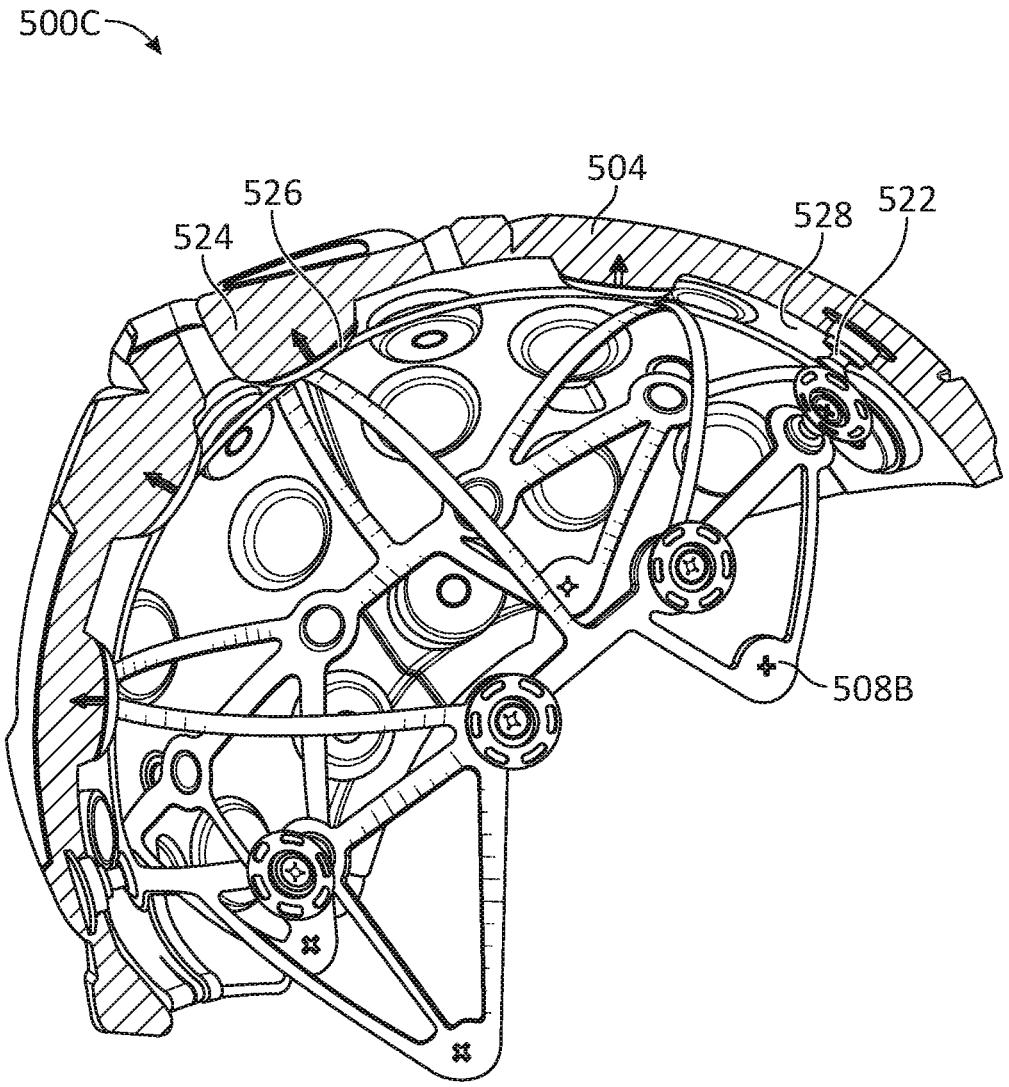
FIG. 5C is another partial side cross-sectional view of certain components of the example helmet, in accordance with an embodiment.

FIG. 5C is another partial side cross-sectional view of certain components of the example helmet, in accordance with an embodiment. Helmet 500C of FIG. 5C illustrates carrier 508B. Dampers 522 are coupled to carrier 508B and outer liner 504. As shown in FIG. 5C, a first end of dampers 522 can be disposed within an opening of outer liner 504. Disposing the first end within the opening can allow for outer liner 504 to securely hold damper 522. A second end of damper 522 can be coupled to carrier 508B. In certain embodiments, the second end of damper 522 can be molded to carrier 508B or can be separate from carrier 508B and coupled to carrier 508B. Damper 522 can allow for and control movement of outer liner 504 relative to carrier 508B.

Furthermore, as shown in FIG. 5C, pads 526 can be inserted into protrusions 524 and held within the protrusions through a barb on an end of pads 526. At least some of pads 526 can be configured to contact carrier 508B when in an unloaded position. Certain displacement of outer liner 504 relative to carrier 508B can then move certain pads 526 so that they no longer contact carrier 508B.

Figure 5D:
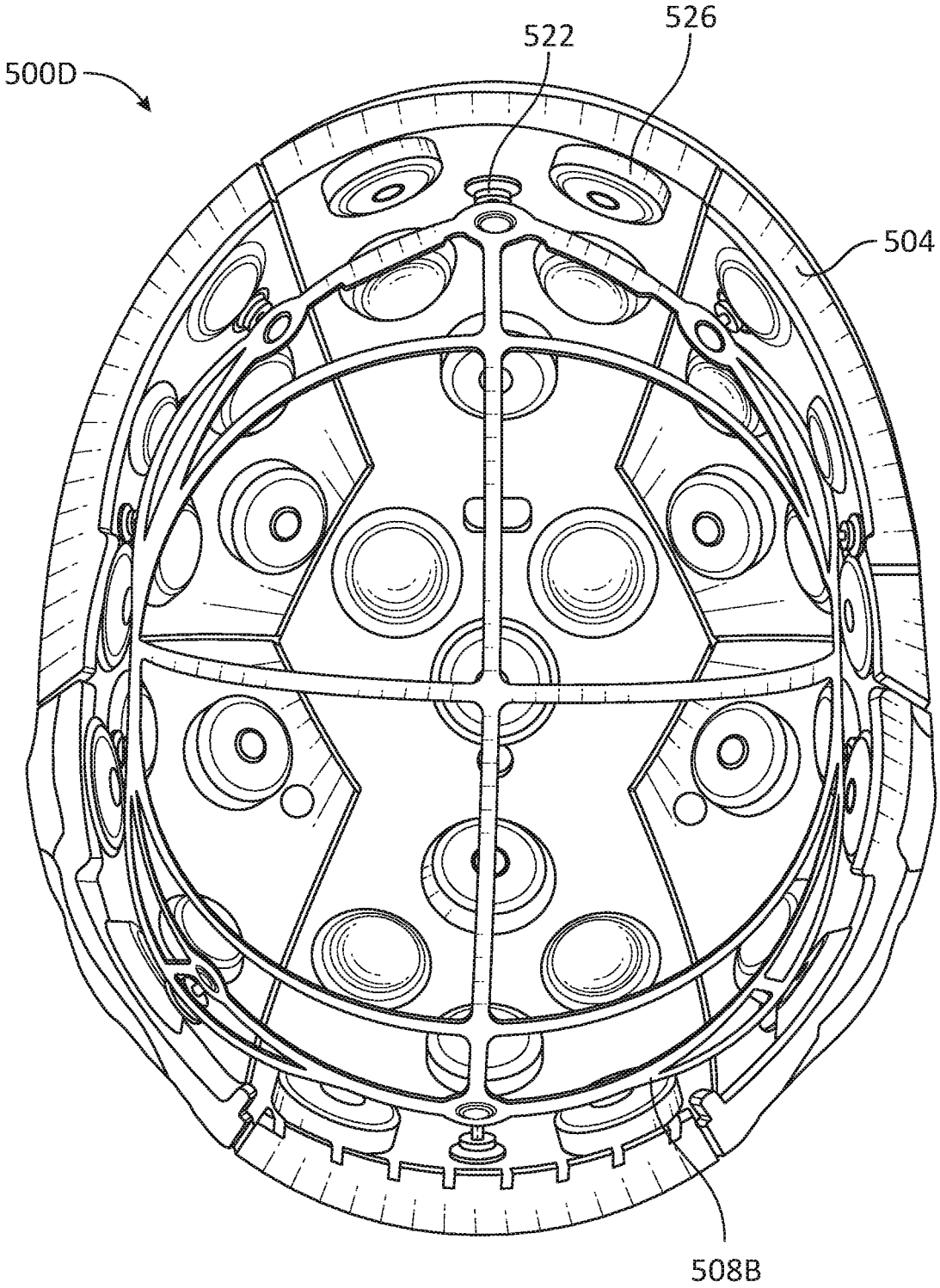
FIG. 5D is a bottom view of certain components of the example helmet, in accordance with an embodiment.

FIG. 5D is a bottom view of certain components of the example helmet, in accordance with an embodiment. FIG. 5D shows helmet 500D with pads 526 and carrier 508B. As shown in FIG. 5D, certain pads 526 do not contact carrier 508B in an unloaded position. In certain such embodiments, pads 526 will only contact carrier 508B or another portion of helmet 500D (not shown) if helmet 500D experiences a force greater than a threshold force that leads to deflection of certain components greater than a threshold deflection amount.

Figure 5E:
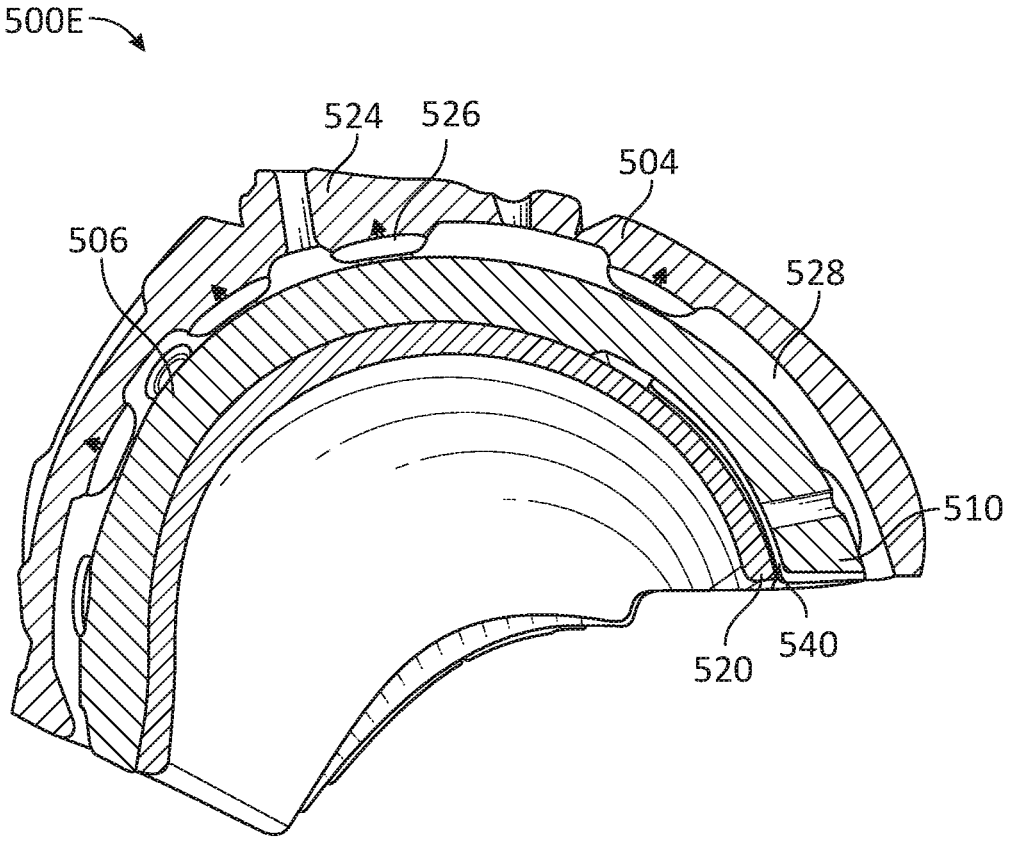
FIG. 5E is a side cross-sectional view of certain components of the example helmet, in accordance with an embodiment.

FIG. 5E is a side cross-sectional view of certain components of the example helmet, in accordance with an embodiment. Helmet 500E shows outer liner 504, omnidirectional liner 506 including compressible liner 510, and comfort liner 520. Air gap 528 is disposed between outer liner 504 and omnidirectional liner 506. Air gap 540 is disposed between omnidirectional liner 506 and comfort liner 520. While in the unloaded position, portions of outer liner 504 can contact omnidirectional liner 506 and portions of omnidirectional liner 506 can contact comfort liner 520, but air gaps 528 and 540 allow for deflection of liners relative to each other when experiencing a load. In certain embodiments, air gaps 528 and/or 540 can be fully or partially filled with compressible materials such as rubber dampers, damping towers, and/or compressible gels or foams in various geometric shapes.

Figure 5F:
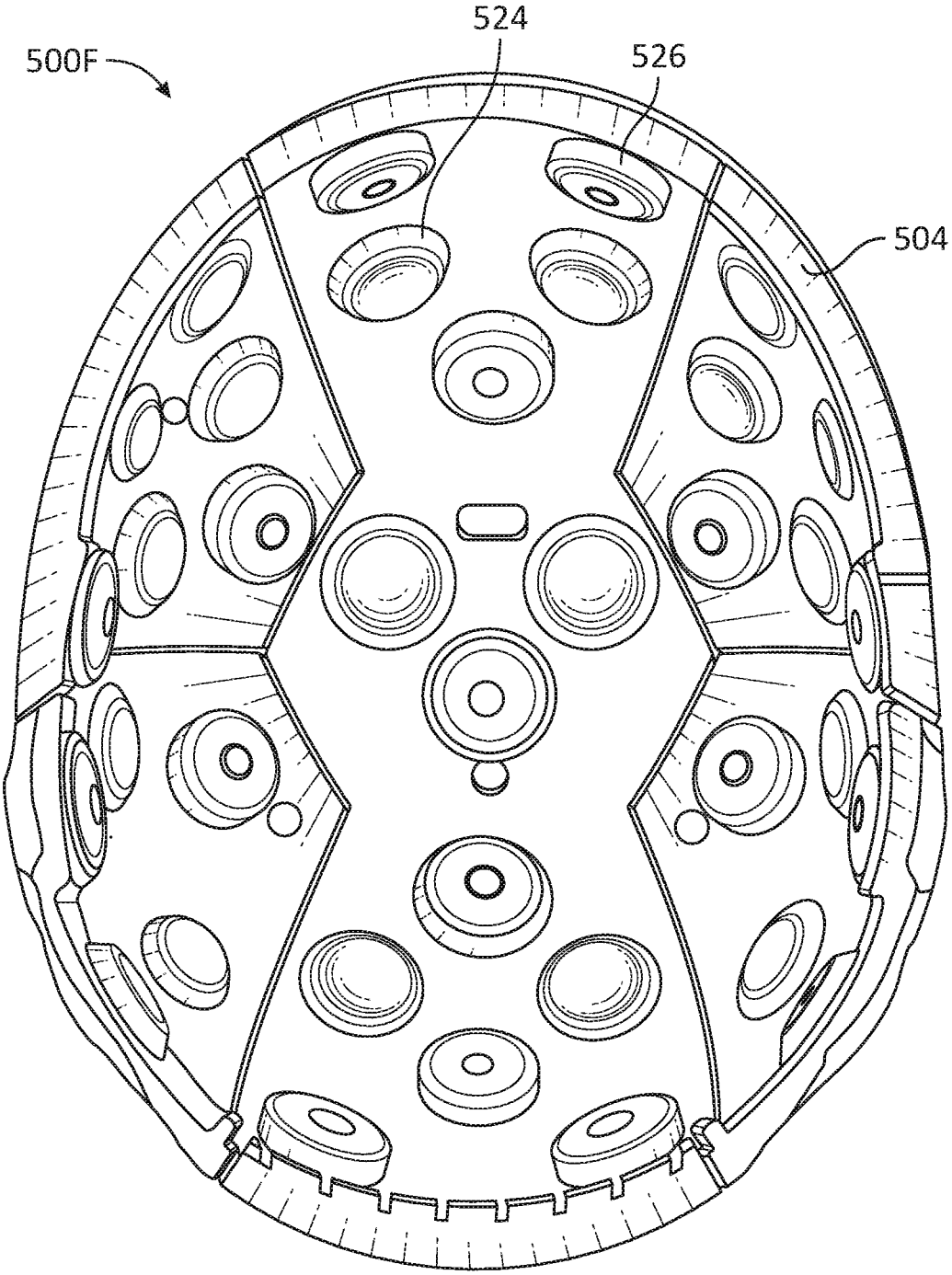
FIG. 5F is a bottom view of certain components of the example helmet, in accordance with an embodiment.

FIG. 5F is a bottom view of certain components of the example helmet, in accordance with an embodiment. As shown in FIG. 5F, outer liner 504 of helmet 500F includes a plurality of sections. Such sections can be defined by grooves or cuts within outer liner 504. Dividing outer liner 504 into sections allows for outer liner 504 to further accommodate omnidirectional movement. The various sections of outer liner 504 can move relative to each other for at least a first distance and thus can move independently or semi-independently of other sections. In other embodiments, other liners (e.g., omnidirectional liner 506 and/or comfort liner 520 or portions thereof) can, additionally or alternatively, be multi-section liners.

Protrusions 524 and pads 526 can be disposed on various sections of the liners. As shown in FIG. 5F, certain pads 526 can be coupled to certain protrusions, but other protrusions may not be coupled to pads 526. As the coefficient of friction of bare protrusions and pads can be different, disposing pads on certain protrusions, but not all protrusions, can be used to tune the impact absorption and resistance to movement of the liners.

Figure 6:
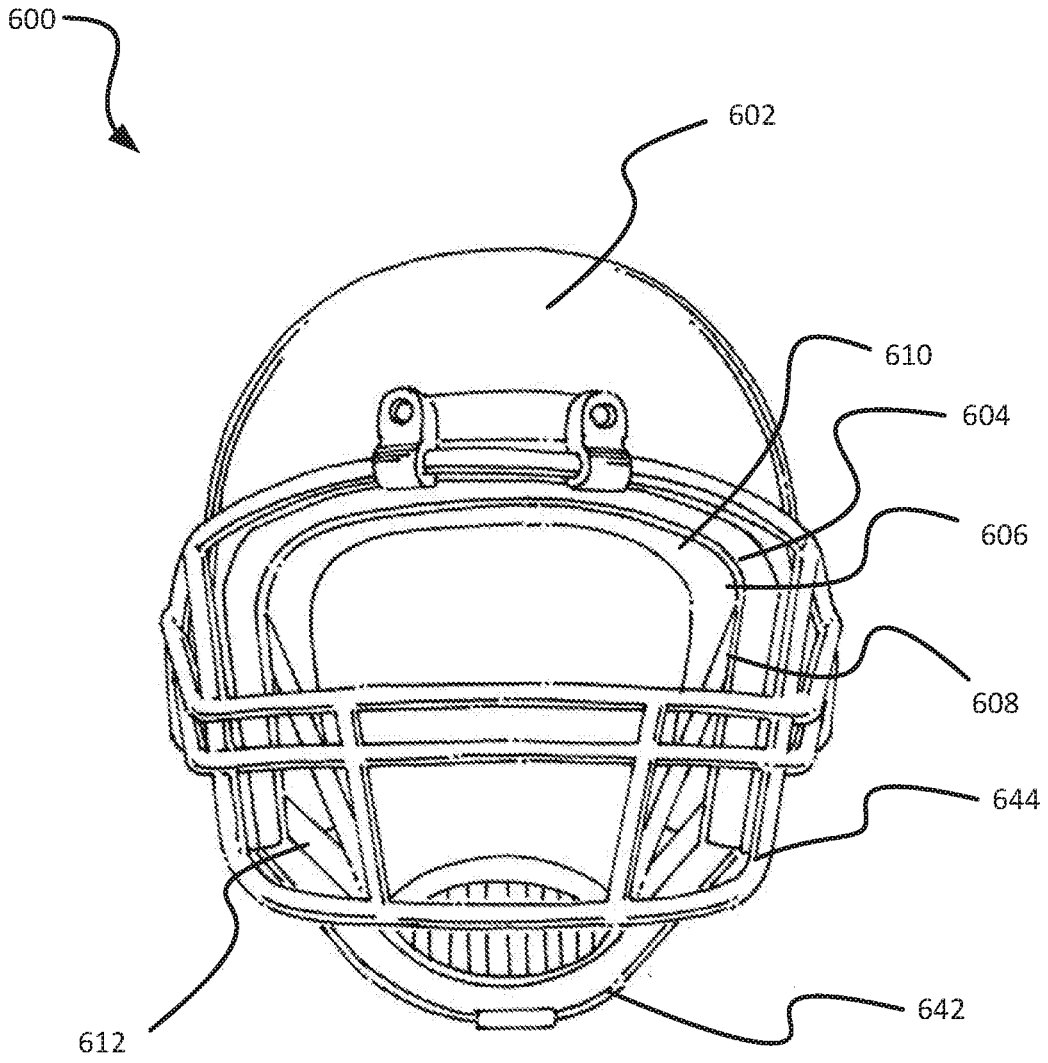
FIG. 6 is a front view of another embodiment of an example helmet with an internal liner coupled chinstrap, in accordance with an embodiment.

FIG. 6 is a front view of another embodiment of an example helmet with an internal liner coupled chinstrap, in accordance with an embodiment. Helmet 600 includes an outer shell 602, outer liner 604, omnidirectional liner 606 including polymer liner 608 and compressible liner 610, first chinstrap 612, second chinstrap 642, and cage 644.

In certain embodiments, first chinstrap 612 can hold a wearer's head securely within omnidirectional liner 606. Second chinstrap 642 can be configured to hold a wearer's head within omnidirectional liner 606 in the event that first chinstrap 612 is no longer holding the wearer's head. Second chinstrap 642 can be coupled to one or more of outer shell 602, outer liner 604, or omnidirectional liner 606. In certain embodiments, second chinstrap 642 may be configured to be more loosely worn than first chinstrap 612 and only contact a wearer's head when needed. The chinstraps described herein may be secured to a wearer through a variety of different methods, including by being moved into placed and adjusted to fit, via buckets, via looping a strap through one or more rings, or through other techniques. Thus, second chinstrap 642 may be configured to keep helmet 600 restrained around the wearer's head as a secondary restraining option.

As shown in FIG. 6, helmet 600 further includes cage 644. Cage 644 provides additional protection by, for example, preventing certain objects from contacting a wearer's face. In certain other embodiments, helmet 600 can additionally or alternatively include visors, masks, and/or outer shell 602 may be configured to extend in front of the wearer's face.

Figure 7:
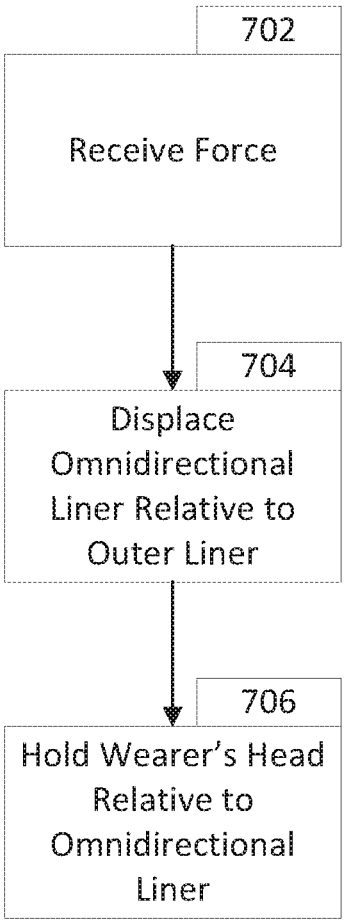
FIG. 7 is a flowchart detailing a method of using the example helmet, in accordance with an embodiment.

FIG. 7 is a flowchart detailing a method of using the example helmet, in accordance with an embodiment. In block 702, a helmet worn by a wearer may receive a force (e.g., an impact force). The impact force may be a force higher than a threshold force. While various liners of the helmet may compress linearly to absorb certain components of the force, the omnidirectional liner, holding the wearer's head, may also displace relative to the outer liner in block 704. The omnidirectional liner may displace omnidirectionally relative to the outer liner to, for example, absorb an oblique component of the force.

While displacing omnidirectionally relative to the outer liner, the omnidirectional liner may hold the securely hold the wearer's head. Thus the wearer's head and the omnidirectional liner may both move relative to the outer liner. In effect, the outer liner translates and/or rotates relative to the wearer's head to and such relative movement absorbs the oblique force, while the wearer's head is secured to the omnidirectional liner via the chinstrap mounted to the omnidirectional liner. Accordingly, omnidirectional movement of the liners of the helmet relative to each other does not impart additional unnecessary forces (e.g., a twisting force) on the wearer's head.

Figure 8:
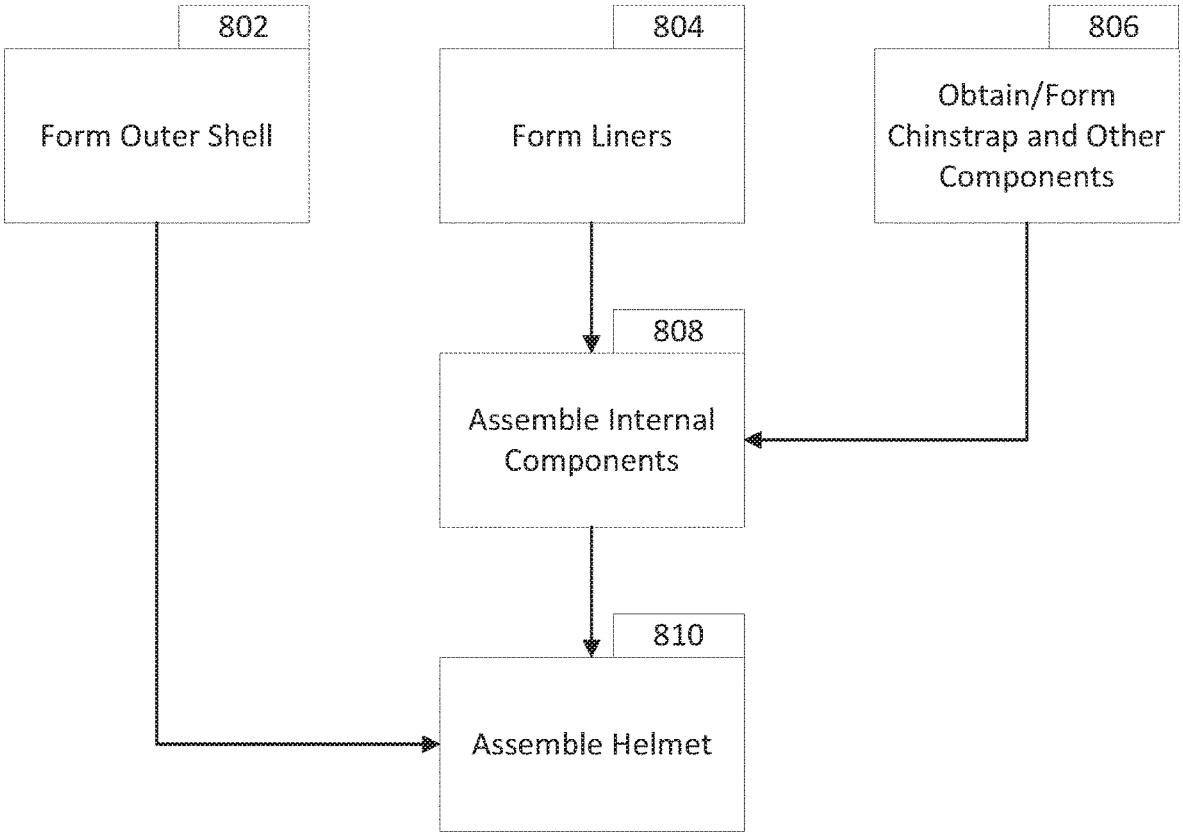
FIG. 8 is a flowchart detailing a method of manufacturing of an example helmet, in accordance with an embodiment.

FIG. 8 is a flowchart detailing a method of manufacturing of an example helmet, in accordance with an embodiment. In block 802, the outer shell of the helmet can be formed. The outer shell can be formed from plastics, composites, and/or other materials appropriate for a hard outer shell of a helmet via lay-up, vacuum forming, injection molding, and/or another appropriate process.

In block 804, liners of the helmet are formed. Liners can be formed of any suitable material, including energy absorbing materials such as expanded polystyrene (EPS) or expanded polypropylene (EPP). Further, additional components (e.g., dampers, rivets, carriers, chinstraps, and/or other components) can be formed and/or obtained in block 806.

The liners and components can be assembled in block 808 by fastening together, gluing, and/or other coupling via other techniques the liners and/or components. The internal components of the helmet can then be coupled to the outer shell in block 810 (e.g., via Velcro padding, adhesives, fasteners, and/or other techniques) to form a complete helmet. In certain embodiments, assembling certain liner(s) and/or other component(s) can form liner assemblies. Such liner assemblies can then be coupled to multiple other parts and/or assemblies to form a complete helmet.

Other embodiments of the impact absorbing system may include any of the impact absorbing system configurations detailed herein in various safety helmets (e.g., sports helmets, construction helmets, racing helmets, helmets worn by armed forces personnel, helmets for the protection of people such as toddlers, bicycle helmets, pilot helmets, and other helmets) as well as in various other safety equipment designed to protect a wearer. Non-limiting examples of such other safety equipment may include body armor such as vests, jackets, and full body suits, gloves, elbow pads, shin pads, hip pads, shoes, helmet protection equipment, and knee pads.

By using different materials and configurations, it is possible to adjust or tune the protection provided by helmets that use the systems of the disclosure, as would be understood by one skilled in the art. The liners and any other layers can be formed from materials with distinct flexibility, compression, and crush characteristics, and the isolation dampers can be formed from various types of elastomers or other appropriate energy absorbing materials, such as MCU. Thus, by controlling the density and stiffness of the isolation dampers and related internal constructional materials, safety helmets can be configured to strategically manage impact energy based on the known range of common head weights expected to be present in any given helmet, and by helmet size, and by any give sporting activity.

In another embodiment, a helmet can include a movable chinguard to help absorb translational forces. Conventional helmets, when absorbing impacts, can twist or torque along a wearer's head. Such conventional helmets with conventional chinguards can, when the helmet twists or torques, apply a corresponding twisting force through the conventional chinguard as the position of the chincup relative to the chinguard is fixed.

FIGS. 9 to 13 illustrate features of a helmet with a movable chinguard that allows for a helmet to twist or torque relative to the wearer's head without the chinguard applying a corresponding such force. The configuration of the helmet and chinguard described in FIGS. 9 to 13 allows for the chincup holding the chin of the wearer to be isolated from (e.g., not directly coupled to) the motion of other components of the helmet.

Figure 9:
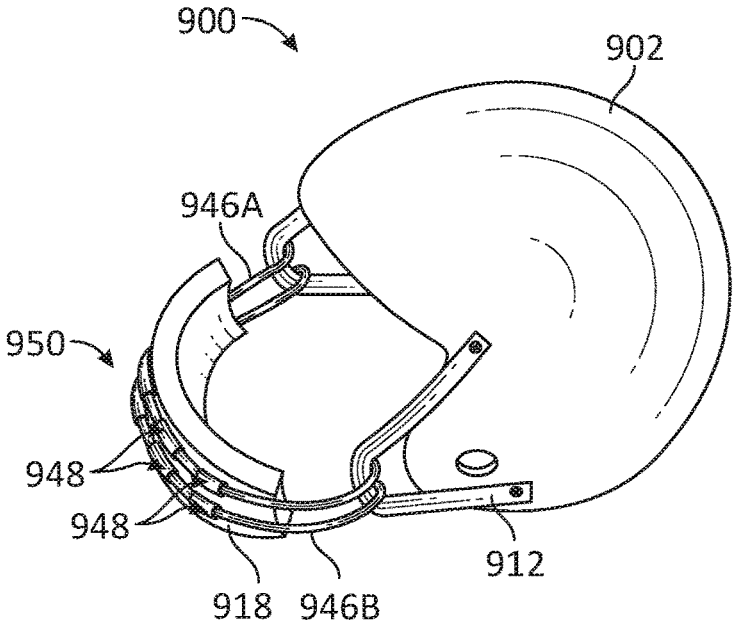
FIG. 9 is a perspective view of an example helmet with a movable chinguard, in accordance with an embodiment.

FIG. 9 is a perspective view of an example helmet with a movable chinguard, in accordance with an embodiment. FIG. 9 illustrates a helmet 900 that includes an outer shell 902, a secondary strap 912 coupled to the outer shell 902, and a chinguard 950 that includes chincup 918 and straps 946A and 946B. Straps 946A and/or 946B can be coupled to the secondary strap 912. In certain embodiments, the straps 946A and/or 946B can be looped around portions of the secondary strap 912. In other embodiments, the straps 946A and/or 946B can be mechanically (e.g., through techniques such as snaps disclosed herein) or adhesively coupled to the secondary strap 912. In certain other embodiments, the straps 946A and/or 946B can be directly coupled to the outer shell 902 (e.g., through mechanical and/or adhesive fastening techniques) and/or another portion of the helmet 900.

The chincup 918 includes strap guides 948. Strap guides 948 can be coupled to straps 946A and/or 946B to allow chincup 918 to move on the straps 946A and/or 946B. Thus, chincup 918 can move from one portion of the straps 946A and/or 946B to another portion of the straps 946A and/or 946B. In certain embodiments, the chincup 918 can slide on the straps 946A and/or 946B. Though the embodiment described herein includes two straps 946A and 946B and corresponding strap guides 948 on the chincup 918, other embodiments may include any number of straps and corresponding strap guides.

Figure 10:
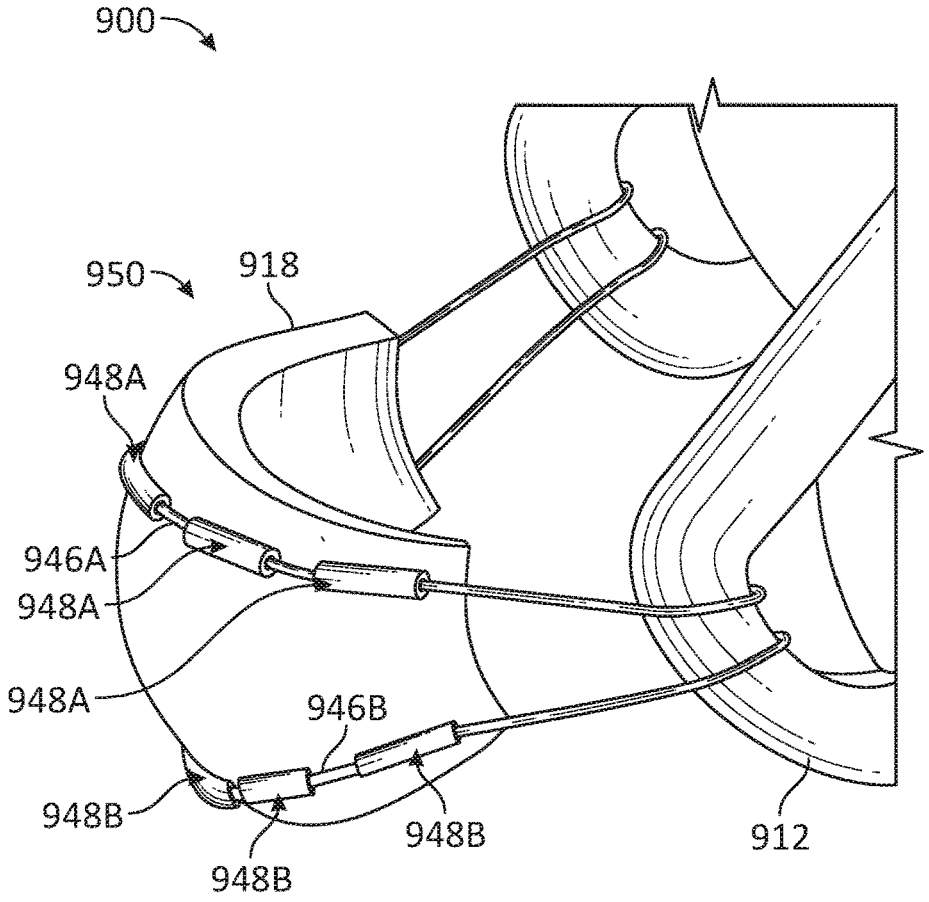
FIG. 10 is a perspective view of the movable chinguard of the helmet of FIG. 9, in accordance with an embodiment.

FIG. 10 is a perspective view of the movable chinguard of the helmet of FIG. 9, in accordance with an embodiment. FIG. 10 shows further details of the chinguard 950. As shown, chincup 918 includes strap guides 948A and 948B. Each of strap guides 948A and 948B may be subdivided into one or more subsections.

As shown, strap 946A may be disposed within (e.g., threaded through or otherwise retained within) strap guide 948A and strap 946B may be disposed within strap guide 948B. Straps 946A and/or 946B may be a cable, a fabric strap, a wire, an elastic band, and/or any other such strap that can hold the chincup 918 on the chin of a wearer. In certain embodiments, fitment of the strap 946A and/or 946B may be adjustable. As shown, straps 946A and 946B may be coupled to secondary strap 912, but other embodiments may couple straps 946A and/or 946B to another portion of the helmet 900. For example, certain embodiments may couple straps 946A and/or 946B to a component that applies tension to the straps 946A and/or 946B (e.g., through a band, ratchet, and/or other component) to firmly secure the chincup 918 to the wearer's chin and/or face.

Strap guides 948A and/or 948B may be a portion of chincup 918 or may be a component separate from chincup 918. Thus, for example, in certain embodiments, the chincup 918 may be molded to include the strap guides 948A and/or 948B. In other embodiments, the strap guides 948A and/or 948B may be formed as separate parts from chincup 918 and coupled to chincup 918 through mechanical or adhesive techniques.

Figure 11:
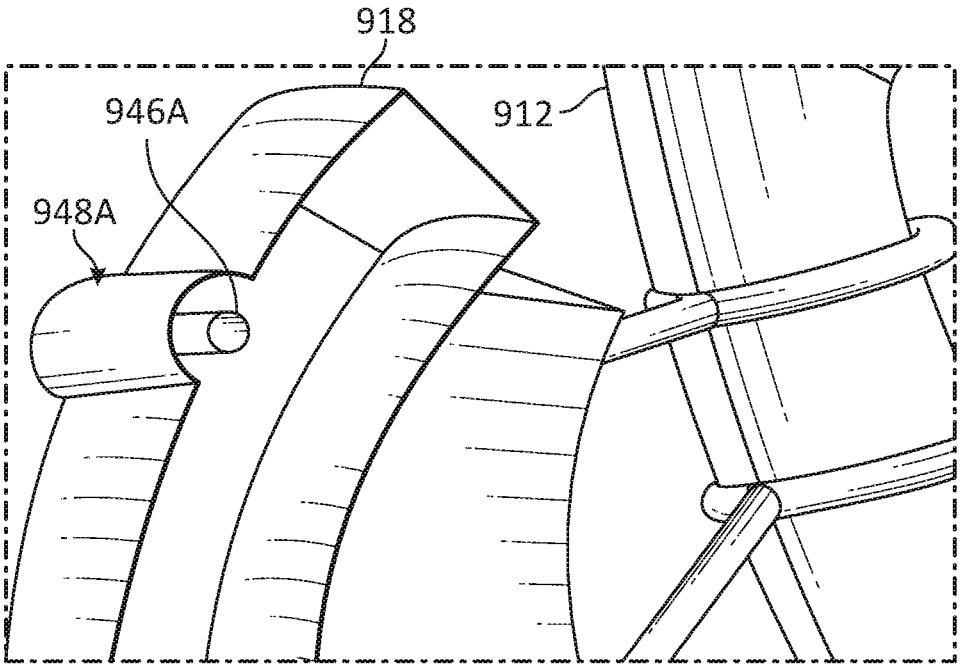
FIG. 11 is a cross-sectional view of the movable chinguard of FIG. 10, in accordance with an embodiment.

The configuration of the chinguard 950 may be further shown in FIG. 11. FIG. 11 is a cross-sectional view of the movable chinguard of FIG. 10, in accordance with an embodiment. In the cross-sectional view of FIG. 11, strap 946A is shown to be disposed within strap guide 948A. Strap 946B may be accordingly disposed within strap guide 948B.

Straps 946A and/or 946B may be loosely retained within strap guides 948A and/or 948B, respectively, or otherwise retained such that chincup 918 may be allowed to move or displace (e.g., slide) along straps 946A and/or 946B. As such, movement of the chincup 918 may be fully or partially decoupled from movement of the rest of helmet 900 (e.g., that of outer shell 902) and chincup 918 may not move and/or accelerate at the same rate as that of the rest of the helmet 900.

Figure 12:
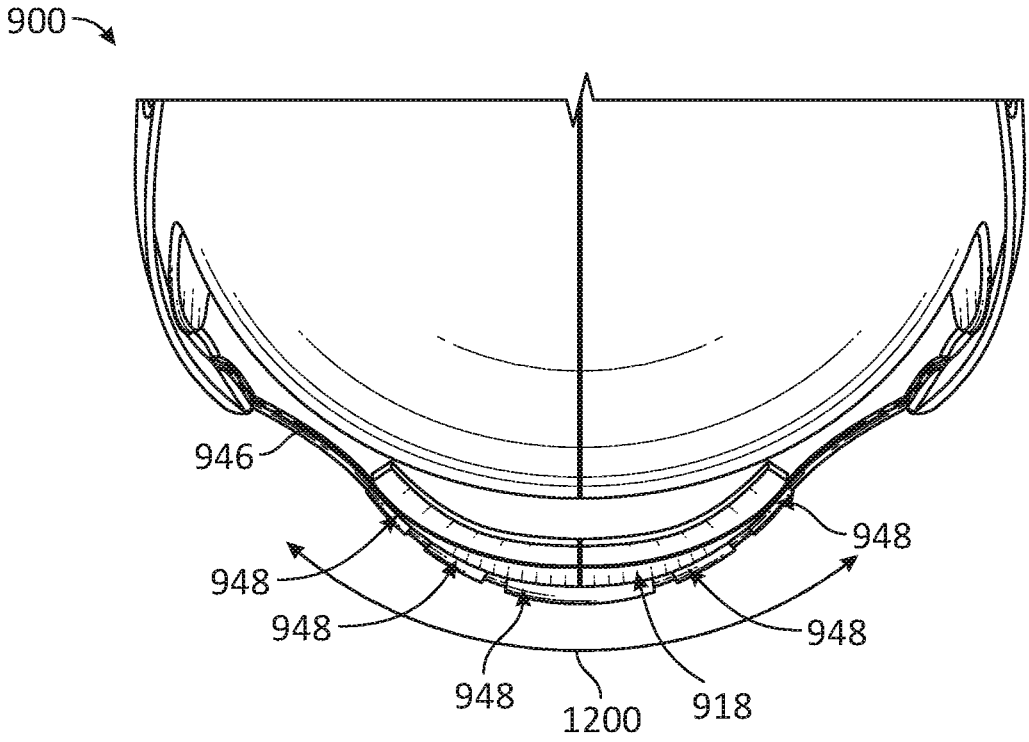
FIG. 12 is a partial top view of the example helmet of FIG. 9, in accordance with an embodiment.

FIG. 12 is a partial top view of the example helmet of FIG. 9, in accordance with an embodiment. FIG. 12 illustrates that chincup 918 may move along direction 1200 along strap 946, which is disposed within strap guides 948. Such movement along direction 1200 may allow for better dissipation of force by helmet 900, preventing injury to the wearer.

Movement of the chincup 918 (e.g., along direction 1200) may be different from that of the rest of the helmet 900 in response to a force received by the helmet 900. The chincup 918 can accordingly move with a wearer's chin instead of being controlled by the position of other parts of the helmet 900 (e.g., the outer shell 902 and/or various liners of the helmet 900). Thus, when the helmet 900 receives a force (e.g., from a blow to the outer shell 902), acceleration experienced by the outer shell 902 is not directly transferred to the wearer's chin through the chincup 918. For example, lateral or side acceleration experienced by the outer shell 902 may be mitigated by the configuration of the chinguard 950, leading to better wearer protection.

Thus, the configuration of the chinguard 950 described herein allows for the chincup 918 to be isolated from (e.g., not directly coupled to) the motion of helmet 900's outer shell 902 and/or other components. The chincup 918 can thus move (e.g., substantially laterally) relative to other components of the helmet 900.

Figure 13:
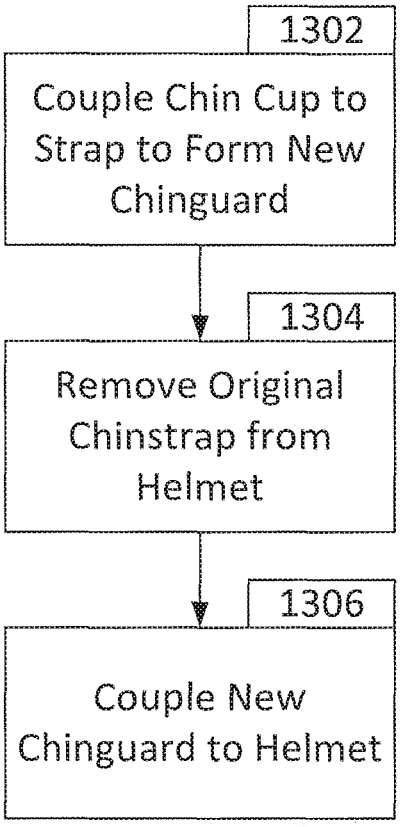
FIG. 13 is a flowchart detailing a method of assembly of the example helmet of FIG. 9, in accordance with an embodiment.

FIG. 13 is a flowchart detailing a method of assembly of the example helmet of FIG. 9, in accordance with an embodiment. While the technique described in FIG. 13 may be used to retrofit a chinguard with the features of chinguard 950 onto a helmet, other embodiments may use a similar technique (e.g., without block 1304) to manufacture a helmet with the features of chinguard 950 described herein.

In block 1302, a chincup including the features as described herein may be formed. In certain embodiments, the chincup may include one or more strap guides while, additionally or alternatively, separate strap guides may be coupled to the chincup. The chincup may be coupled to one or more straps as described here to form the chinguard.

In block 1304, a chinstrap without the features of the chinguard described herein (e.g., without a movable chincup) may be removed from the helmet. Such a chinstrap can be removed through detaching of mechanical fasteners, through cutting away of the chinstrap, or through other techniques.

Once the chinstrap has been detached, the chinguard may be coupled to the helmet in block 1306. The chinguard may be coupled similarly to how the chinstrap was coupled to the helmet (e.g., through mechanical techniques). However, other embodiments may couple the chinguard to the helmet through another technique (e.g., by looping the straps around a secondary strap of the helmet). In certain additional embodiments, the original chinstrap may not be removed or may be only partially removed. Accordingly, a chinguard as described herein may be retrofitted to an existing helmet or manufactured.

Figure 14:
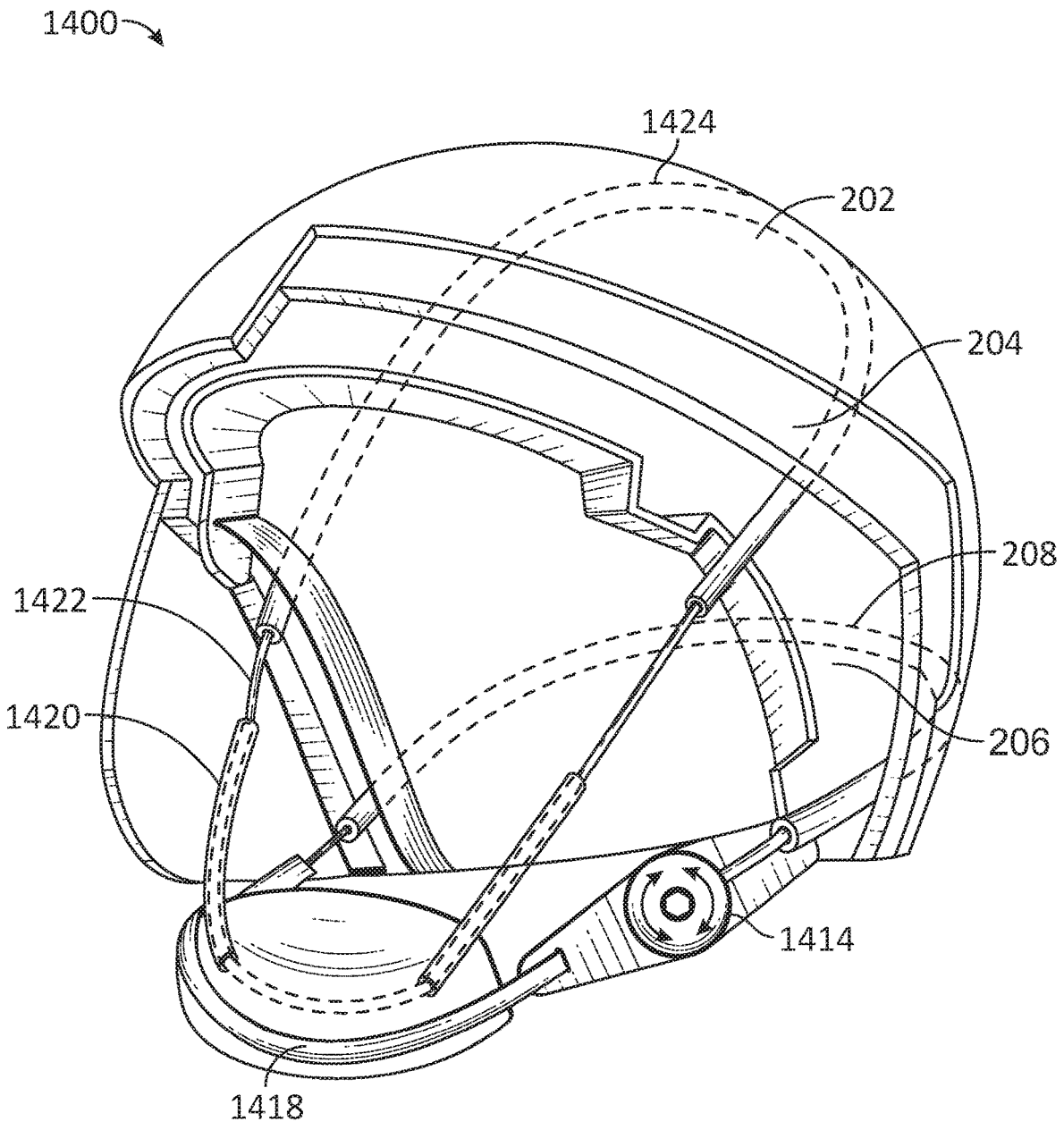
FIG. 14 is a partial cutaway prospective view of another example helmet with a movable chinstrap, in accordance with an embodiment.

FIG. 14 is a partial cutaway prospective view of another example helmet with a movable chinstrap, in accordance with an embodiment. FIG. 14 illustrates helmet 1400 that includes outer shell 202, outer liner 204, omnidirectional liner 206, and polymer liner 208. Outer shell 202, outer liner 204, omnidirectional liner 206, and polymer liner 208 may be similar to corresponding components described herein.

Helmet 1400 may additionally include an adjustable tension chinstrap 1414 and chincup 1418. Adjustable tension chinstrap 1414 may be a Boa® style tension adjuster or another tension adjuster (e.g., a turnbuckle, ratchet, wheel adjuster, or other type of mechanism that can adjust a tension of a strap or cable). Adjustable tension chinstrap 1414 may, for example, be spring loaded. Such springs may apply a desired amount of tension.

Thus, a tension adjuster may allow for a force to be continuously exerted on the chin of the wearer and, accordingly, for helmet 1400 to maintain a snug fit with the wearer. The snug fit may allow for a more comfortable and protective fit as, with conventional helmets, a wearer may often wear the helmet too loosely or too tightly for maximum safety. Adjustable tension chinstrap 1414 automatically sets the appropriate tension by applying a holding force to a chin of a wearer via chincup 1418 and, thus, may avoid such a situation.

Adjustable tension chinstrap 1414 may adjust a length of the chinstrap. In certain embodiments, adjustable tension chinstrap 1414 may be user adjustable. That is, a user may adjust an amount of tension applied to the chin of a wearer by the tension adjuster by, for example, turning a control wheel or adjusting a buckle. Thus, the user may adjust the pre-loaded tension to a level that is comfortable. Adjustable tension chinstrap 1414 may include one or more straps, cables, or other attachments coupled to the tension adjuster. Certain ones of such attachments may be coupled to the tension adjuster on a first end and coupled to chincup 1418 on a second end.

In order to accommodate the adjustments in the length of the chinstrap, chincup 1418 may be a movable chincup similar to chincup 918. Such a movable chincup 1418 may remain centered on the wearer's chin as the length of the chinstrap is changed. Accordingly, chincup 1418 may be coupled to cable 1422 on one or more sides and configured to displace along cable 1422 and/or other cables based on the length of the chinstrap and/or external forces received. Cable 1422 may be disposed within cable housing 1420. Cable housing 1420 may be a sleeve covering that protects cable 1422 from damage or from external objects that may prevent movement of cable 1422.

The cables and/or straps coupled to chincup 1418 and/or adjustable tension chinstrap 1414 may be further coupled to internal straps 1424. Internal straps 1424 may, for example, be coupled to cable 1422 on a first end via one or more mechanical connections, another cable (e.g., a cable coupled to adjustable tension chinstrap 1414) on a second end via one or more mechanical connections, and looped around the outside, looped around the inside, or looped through an interior of one or more liners (e.g., outer liner 204, omnidirectional liner 206, and polymer liner 208). Looping internal straps 1424 around liners may allow for further coupling of chincup 1418 to displace with the liners (e.g., move along with omnidirectional liner 206), as described herein. Furthermore, such looping may allow for a stronger strap, decreasing the chances of damage when absorbing force.

As such, chincup 1418 may displace along with one or more liners (e.g., omnidirectional liner 206) to decrease the chances of a DAI injury. Chincup 1418 may move relative to the liners (e.g., omnidirectional liner 206) along cable 1422 or other cables or straps to further absorb impacts. Furthermore, chincup 1418 may be securely worn by the user through automatically adjusted tension imparted by adjustable tension chinstrap 1414.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but should be accorded the widest possible scope consistent with the principles and features disclosed herein.

What is claimed is:

1. A helmet comprising:

an outer shell;

a first liner disposed within and coupled to the outer shell and configured to move omnidirectionally relative to the outer shell; and a chinstrap coupled to the first liner, wherein the chinstrap is mechanically coupled to the first liner along a peripheral portion of the first liner, wherein the chinstrap is mechanically coupled to the first liner via one or more of a magnetic coupling, snaps, stitching, rivets, buckles, threaded fasteners, or cables, and wherein the outer shell comprises a window configured to allow access to the one or more of the magnetic coupling, snaps, stitching, rivets, buckles, threaded fasteners, or cables.

2. The helmet of claim 1, further comprising:

a second liner disposed within the outer shell and coupled to the outer shell, wherein the first liner is disposed within and coupled to the second liner and coupled to the outer shell via the second liner;

a damper comprising a first end and a second end, wherein the first end is coupled to the second liner and the second end is coupled to the first liner, and wherein the damper holds the second liner in a first resting spatial position relative to the first liner and allows omnidirectional movement of the first liner relative to the second liner in response to a force received by the helmet; and a chincup coupled to the chinstrap.

3. The helmet of claim 2, further comprising:

an air gap disposed between the second liner and the first liner, wherein the first liner comprises a compressible liner and a polymer liner coupled to the compressible liner, and wherein the chinstrap is coupled to the polymer liner.

4. A helmet comprising:

an outer shell;

a first liner disposed within and coupled to the outer shell and configured to move omnidirectionally relative to the outer shell, wherein the first liner comprises a compressible liner and a polymer liner coupled to the compressible liner;

a second liner disposed within the outer shell and coupled to the outer shell, wherein the first liner is disposed within and coupled to the second liner and coupled to the outer shell via the second liner, wherein the compressible liner comprises a first thickness and the polymer liner comprises a second thickness, wherein the first thickness is thicker than the second thickness, wherein the polymer liner is disposed between the second liner and the compressible liner, and wherein the compressible liner comprises a first material with a first modulus of elasticity and the polymer liner comprises a second material with a second modulus of elasticity higher than the first modulus of elasticity;

an air gap disposed between the second liner and the first liner;

a damper comprising a first end and a second end, wherein the first end is coupled to the second liner and the second end is coupled to the first liner, and wherein the damper holds the second liner in a first resting spatial position relative to the first liner and allows omnidirectional movement of the first liner relative to the second liner in response to a force received by the helmet;

a chinstrap coupled to the first liner and the polymer liner; and a chincup coupled to the chinstrap.

5. A helmet comprising:

an outer shell;

a first liner disposed within and coupled to the outer shell and configured to move omnidirectionally relative to the outer shell, wherein the first liner comprises a first compressible liner, a second compressible liner, and a polymer liner, wherein the polymer liner is disposed between the first compressible liner and the second compressible liner and coupled to the first compressible liner and the second compressible liner;

a second liner disposed within the outer shell and coupled to the outer shell, wherein the first liner is disposed within and coupled to the second liner and coupled to the outer shell via the second liner;

an air gap disposed between the second liner and the first liner;

a damper comprising a first end and a second end, wherein the first end is coupled to the second liner and the second end is coupled to the first liner, and wherein the damper holds the second liner in a first resting spatial position relative to the first liner and allows omnidirectional movement of the first liner relative to the second liner in response to a force received by the helmet;

a chinstrap coupled to the first liner and the polymer liner; and a chincup coupled to the chinstrap.

6. The helmet of claim 2, further comprising:

a comfort liner disposed within the first liner and coupled to the first liner, wherein the first liner is configured to rotate and/or translate relative to the second liner in response to the force received by the helmet.

7. The helmet of claim 5, wherein the chinstrap is adhesively coupled to the first liner along a peripheral portion of the first liner.

8. The helmet of claim 1, wherein the chinstrap comprises a central portion, a left side first portion, a left side second portion, a right side first portion, and a right side second portion, and wherein each of the left side first portion, the left side second portion, the right side first portion, and the right side second portion are coupled to the first liner.

9. The helmet of claim 1, wherein the chinstrap is a first chinstrap, wherein the helmet further comprises a second chinstrap separate from the first chinstrap, and wherein the second chinstrap is coupled to the outer shell.

10. The helmet of claim 3, wherein the first liner further comprises a carrier, wherein a portion of the carrier is disposed on a surface of the compressible liner.

11. A method of using the helmet of claim 1, the method comprising:

receiving a force with the outer shell;

absorbing at least a portion of the force with the outer shell by translating or rotating the outer shell relative to the first liner; and holding a wearer's head in a substantially fixed position relative to the first liner with the chinstrap.

12. The helmet of claim 1, further comprising:

a chincup comprising a strap guide and coupled to the chinstrap having a strap;

wherein a portion of the strap is disposed within the strap guide, and wherein the chincup is configured to move along the portion of the strap to move relative to the helmet.

13. The helmet of claim 12, wherein the chincup is configured to slide along the strap.

14. The helmet of claim 12, wherein the strap is a cable.

15. The helmet of claim 12, wherein the chincup further comprises a plurality of strap guides, and wherein the strap is disposed within each of the strap guides.

16. The helmet of claim 12, wherein the strap further comprises a tension adjuster configured to adjust a length of the strap and apply a holding force to a chin of a wearer via the chincup.

17. The helmet of claim 12, wherein the chinguard is configured to hold a chin of a wearer within the chincup when the helmet moves relative to a head of the wearer, and wherein the strap is configured to mechanically couple to the outer shell and/or a secondary strap of the helmet.

18. The helmet of claim 12, further comprising:

and a second liner disposed within the outer shell and coupled to the outer shell, wherein the first liner is disposed within and coupled to the second liner and coupled to the outer shell via the second liner.

19. The helmet of claim 18, further comprising:

a damper comprising a first end and a second end, wherein the first end is coupled to the second liner and the second end is coupled to the first liner, and wherein the damper holds the second liner in a first resting spatial position relative to the first liner and allows omnidirectional movement of the first liner relative to the second liner in response to a force received by the helmet.

* * * * *